US009999313B2

(12) United States Patent
Mullet et al.

(10) Patent No.: US 9,999,313 B2
(45) Date of Patent: Jun. 19, 2018

(54) MOTORIZED DRAPERY APPARATUS, SYSTEM AND METHOD OF USE

(71) Applicant: QMotion, Incorporated, Pensacola, FL (US)

(72) Inventors: Willis J Mullet, Gulf Breeze, FL (US); Michael D Fox, Pensacola, FL (US); Daniel T Matthews, Pensacola, FL (US); Dale McCarthy, Pensacola, FL (US); Darrin W. Brunk, Pensacola, FL (US)

(73) Assignee: CURRENT PRODUCTS CORP., Pensacola, FL (US)

( * ) Notice: Subject to any disclaimer, the term of this patent is extended or adjusted under 35 U.S.C. 154(b) by 0 days. days.

(21) Appl. No.: 14/786,877

(22) PCT Filed: Apr. 10, 2014

(86) PCT No.: PCT/US2014/033602

§ 371 (c)(1),
(2) Date: Oct. 23, 2015

(87) PCT Pub. No.: WO2014/169093

PCT Pub. Date: Oct. 16, 2014

(65) Prior Publication Data

US 2016/0143470 A1 May 26, 2016

Related U.S. Application Data

(60) Provisional application No. 61/810,949, filed on Apr. 11, 2013, provisional application No. 61/817,954, filed on May 1, 2013.

(51) Int. Cl.
*A47H 5/02* (2006.01)
*A47H 1/102* (2006.01)
(Continued)

(52) U.S. Cl.
CPC ..... *A47H 5/02* (2013.01); *A47H 1/102* (2013.01); *E06B 9/68* (2013.01); *E06B 9/72* (2013.01)

(58) Field of Classification Search
CPC .... A47H 5/02; E06B 9/68; E06B 9/72; E06B 9/70
(Continued)

(56) References Cited

U.S. PATENT DOCUMENTS

D5,178 S 8/1871 Gould
D22,271 S 3/1893 Ruxton
(Continued)

FOREIGN PATENT DOCUMENTS

DE 3402122 8/1984
JP 2006304984 11/2006
(Continued)

OTHER PUBLICATIONS

SomfySystems "How to Video: Re-loadable Battery Wand" Aug. 11, 2011 <https://www.youtube.com/watch?v=xxR5tj3HO2M>.*
(Continued)

*Primary Examiner* — Katherine W Mitchell
*Assistant Examiner* — Johnnie A. Shablack
(74) *Attorney, Agent, or Firm* — Christopher A. Proskey; BrownWinick Law Firm

(57) ABSTRACT

An architectural covering is presented having a rotatable drive element having a guide structure and a plurality of idler attachment elements and a drive element positioned over the rotatable drive element. The rotatable drive element is connected to a wall, ceiling or other structure by brackets. In one arrangement a drive shaft having at least one bearing is then attached to the brackets such that the rotatable drive elements rotate upon the bearings. This arrangement pro-
(Continued)

vides an efficient, simple and convenient manner of attaching a rotatable drive element to brackets for mounting.

19 Claims, 19 Drawing Sheets

(51) Int. Cl.
*E06B 9/68* (2006.01)
*E06B 9/72* (2006.01)

(58) Field of Classification Search
USPC ..... 160/331
See application file for complete search history.

(56) References Cited

U.S. PATENT DOCUMENTS 537,681 A 4/1895 Furbish
D25,521 S 5/1896 Ill
D41,567 S 7/1911 Rouse
1,509,620 A * 9/1924 Taylor ..... B60S 1/18 15/250.26
1,823,909 A 9/1931 Meier
2,801,690 A 8/1957 Bennett
3,095,033 A * 6/1963 Polkosnik ..... A47H 1/122 160/126
3,208,507 A * 9/1965 Breen ..... E06B 9/364 160/168.1 V
3,333,622 A * 8/1967 Graber ..... A47H 5/032 16/87.4 R
3,631,659 A 1/1972 Horowitz et al.
3,774,665 A * 11/1973 Bourne ..... A47H 5/06 16/87.6 R
3,853,166 A 12/1974 Wrono
3,930,738 A 1/1976 Thuss et al.
3,999,110 A 12/1976 Ramstrom et al.
4,023,609 A 5/1977 Rosenquist
4,096,903 A 6/1978 Ringle, III
4,131,831 A 12/1978 Bochenek et al.
4,160,348 A 7/1979 Chapman et al.
4,160,972 A * 7/1979 La Mell ..... G08B 13/08 160/10
4,171,845 A 10/1979 Hirsch
4,223,714 A 9/1980 Weinreich et al.
4,305,448 A * 12/1981 Stoll ..... A47H 5/02 160/331
4,399,855 A 8/1983 Volfson
4,427,050 A 1/1984 Toppen
RE31,793 E 1/1985 Berman et al.
4,495,978 A 1/1985 Carroll
4,532,194 A 7/1985 Liautaud et al.
4,572,467 A 2/1986 Farrell
4,644,244 A 2/1987 Kittelson
4,724,885 A 2/1988 Chang
4,731,965 A 3/1988 Jensen
4,766,941 A 8/1988 Sloop et al.
4,773,464 A * 9/1988 Kobayashi ..... E06B 9/32 160/168.1 P
4,807,686 A 2/1989 Schnebly et al.
4,831,509 A 5/1989 Jones et al.
4,832,104 A 5/1989 De Labarthe et al.
4,865,107 A 9/1989 Dube
4,926,922 A * 5/1990 Shimazaki ..... A47H 5/06 160/331
4,951,730 A * 8/1990 Hsu ..... E06B 9/70 160/23.1
4,956,588 A 9/1990 Ming
4,979,582 A 12/1990 Forester
D315,415 S 3/1991 Anthony et al.
5,054,605 A 10/1991 Bavis
D324,328 S 3/1992 Pagan
D324,645 S 3/1992 Magro et al.
5,123,079 A 6/1992 Tanii et al.
5,133,330 A 7/1992 Sharp
5,133,399 A 7/1992 Hiller et al.
5,271,446 A 12/1993 Hwang
5,278,480 A 1/1994 Murray
D355,353 S 2/1995 Pozzi
D355,587 S 2/1995 Pozzi
5,412,553 A * 5/1995 Wojski ..... A47H 1/00 362/147
5,419,010 A * 5/1995 Mullet ..... E05D 13/1261 16/198
5,434,487 A 7/1995 Long et al.
5,445,209 A 8/1995 Lichy
5,462,105 A 10/1995 Supernak
5,467,808 A 11/1995 Bell
5,482,100 A 1/1996 Kuhar
5,509,239 A 4/1996 Fullwood
5,547,008 A 8/1996 Sullivan
5,566,736 A 10/1996 Crider et al.
5,655,342 A 8/1997 Guillemet et al.
5,655,343 A 8/1997 Seals
5,714,855 A 2/1998 Domel et al.
D391,476 S 3/1998 Gourlay
5,729,103 A 3/1998 Domel et al.
5,752,557 A 5/1998 Crider et al.
5,760,558 A 6/1998 Popat
5,785,105 A 7/1998 Crider et al.
5,793,174 A 8/1998 Kovach et al.
5,813,447 A 9/1998 Lysyj
RE36,058 E 1/1999 Sokol
5,883,480 A 3/1999 Domel et al.
5,889,377 A 3/1999 Mao
5,905,442 A 5/1999 Mosebrook et al.
5,907,227 A 5/1999 Domel et al.
5,929,580 A 7/1999 Mullet et al.
5,960,847 A 10/1999 Crider et al.
5,990,646 A 11/1999 Kovach et al.
6,004,298 A 12/1999 Levander
D418,741 S 1/2000 Rouse
6,020,829 A 2/2000 Hormann
6,024,156 A * 2/2000 Chu ..... A47H 5/0325 160/331
6,055,885 A 5/2000 Shea
6,060,852 A * 5/2000 Domel ..... E06B 9/307 160/168.1 P
6,062,290 A * 5/2000 Domel ..... E06B 9/36 160/176.1 V
6,069,465 A 5/2000 De Boois et al.
6,082,433 A 7/2000 Vafaie et al.
6,125,907 A 10/2000 Tokuyama et al.
6,125,909 A * 10/2000 Walker ..... A47H 1/04 160/126
6,144,177 A 11/2000 Mao
6,181,089 B1 1/2001 Kovach et al.
6,189,592 B1 2/2001 Domel
6,201,364 B1 * 3/2001 Will ..... E06B 9/174 160/1
6,212,221 B1 4/2001 Wakayama et al.
6,215,265 B1 * 4/2001 Wolfer ..... E06B 9/72 160/310
6,259,218 B1 7/2001 Kovach et al.
6,286,579 B1 9/2001 Gottschalk
6,369,530 B2 4/2002 Kovach et al.
6,376,832 B1 4/2002 Smith et al.
6,433,498 B1 8/2002 Domel et al.
6,489,169 B1 12/2002 Cohen et al.
6,497,267 B1 12/2002 Azar et al.
6,533,017 B1 3/2003 Toti
6,550,733 B1 4/2003 Lassen et al.
6,606,072 B1 8/2003 Hayward et al.
6,680,594 B2 1/2004 Huber et al.
6,708,750 B2 3/2004 Collett et al.
6,733,413 B2 5/2004 Lagarde et al.
6,736,186 B2 5/2004 Anderson et al.
6,850,017 B1 2/2005 Domel et al.
6,870,338 B2 3/2005 Walker et al.
6,959,748 B2 11/2005 Hudoba
6,967,565 B2 11/2005 Lingemann
6,979,962 B2 12/2005 Cavarec et al.
7,033,695 B2 4/2006 Sawachi

(56) References Cited

U.S. PATENT DOCUMENTS

| | | | | |
|---|---|---|---|---|
| 7,051,782 | B2 * | 5/2006 | Nichols, Jr. | E06B 9/174 160/120 |
| 7,104,305 | B1 | 9/2006 | Apollon | |
| 7,111,659 | B2 | 9/2006 | Harper et al. | |
| 7,137,530 | B2 | 11/2006 | Chirnomas | |
| 7,193,502 | B2 | 3/2007 | Vandrunen et al. | |
| 7,231,953 | B2 | 6/2007 | Varley et al. | |
| 7,240,716 | B2 * | 7/2007 | Nichols, Jr. | E06B 9/174 160/120 |
| 7,259,485 | B2 | 8/2007 | Cavarec et al. | |
| D553,965 | S | 10/2007 | Ellbogen | |
| 7,281,561 | B2 | 10/2007 | Anderson et al. | |
| 7,299,848 | B2 | 11/2007 | Streib et al. | |
| 7,346,016 | B2 | 3/2008 | Nielsen et al. | |
| 7,350,736 | B2 | 4/2008 | Caamano et al. | |
| 7,356,041 | B2 | 4/2008 | Nielsen et al. | |
| 7,389,806 | B2 | 6/2008 | Kates | |
| 7,438,111 | B2 | 10/2008 | Grimes et al. | |
| 7,590,433 | B2 | 9/2009 | Sung et al. | |
| 7,635,018 | B2 * | 12/2009 | Carmen, Jr. | E06B 9/68 160/188 |
| 7,673,667 | B2 | 3/2010 | Domel et al. | |
| 7,690,414 | B2 | 4/2010 | Knowles | |
| 7,726,379 | B2 * | 6/2010 | Beau | E06B 9/72 160/310 |
| 7,931,068 | B2 | 4/2011 | Carmen, Jr. et al. | |
| 7,975,748 | B2 | 7/2011 | Yu et al. | |
| 8,113,263 | B2 * | 2/2012 | Reed | E05F 15/40 160/188 |
| 8,125,167 | B1 | 2/2012 | Mullet et al. | |
| 8,267,234 | B2 * | 9/2012 | Koop | F16D 7/044 160/120 |
| 8,299,734 | B2 | 10/2012 | Mullet et al. | |
| 8,340,975 | B1 | 12/2012 | Rosenberger | |
| 8,368,328 | B2 | 2/2013 | Mullet et al. | |
| 8,371,358 | B1 | 2/2013 | Mullet et al. | |
| 8,540,005 | B2 | 9/2013 | Baugh et al. | |
| 8,575,872 | B2 | 11/2013 | Mullet et al. | |
| 8,659,246 | B2 | 2/2014 | Mullet et al. | |
| 8,723,455 | B2 | 5/2014 | Mullet et al. | |
| 8,757,239 | B2 | 6/2014 | Colson et al. | |
| D714,132 | S | 9/2014 | Hazantonis | |
| 8,892,262 | B2 | 11/2014 | Mullet et al. | |
| 8,919,419 | B2 | 12/2014 | Mullet et al. | |
| 8,968,900 | B2 | 3/2015 | Mullet et al. | |
| 9,045,939 | B2 | 6/2015 | Blair et al. | |
| 9,095,907 | B2 * | 8/2015 | Mullet | E06B 9/72 |
| 9,095,908 | B2 * | 8/2015 | Mullet | E06B 9/72 |
| 9,249,623 | B2 * | 2/2016 | Mullet | E06B 9/42 |
| 2004/0169116 | A1 | 9/2004 | Nogare et al. | |
| 2006/0000565 | A1 | 1/2006 | Billebault | |
| 2006/0086874 | A1 | 4/2006 | Habel et al. | |
| 2006/0130983 | A1 * | 6/2006 | Nien | A47H 1/02 160/330 |
| 2006/0231215 | A1 * | 10/2006 | Loo | E06B 9/88 160/133 |
| 2007/0029050 | A1 * | 2/2007 | Nien | A47H 1/142 160/84.01 |
| 2007/0261801 | A1 | 11/2007 | Mullet et al. | |
| 2007/0284053 | A1 | 12/2007 | Mullet et al. | |
| 2008/0230192 | A1 * | 9/2008 | Kane | E06B 9/40 160/311 |
| 2009/0127369 | A1 | 5/2009 | Mullet et al. | |
| 2009/0283225 | A1 * | 11/2009 | Luger | A47H 5/0325 160/310 |
| 2010/0122781 | A1 * | 5/2010 | Charleux | A47H 5/0325 160/331 |
| 2011/0056630 | A1 | 3/2011 | Buccola, Jr. | |
| 2011/0265958 | A1 * | 11/2011 | Skinner | E06B 9/322 160/127 |
| 2012/0181979 | A1 | 7/2012 | Hudspeth et al. | |
| 2012/0279075 | A1 | 11/2012 | Amsel | |
| 2013/0199735 | A1 | 8/2013 | Colson et al. | |
| 2013/0204408 | A1 | 8/2013 | Thiruvengada | |
| 2013/0333848 | A1 | 12/2013 | Mullet et al. | |
| 2014/0014281 | A1 | 1/2014 | Mullet et al. | |
| 2014/0076503 | A1 * | 3/2014 | Mullet | E06B 9/72 160/84.02 |
| 2014/0076505 | A1 * | 3/2014 | Mullet | E06B 9/72 160/108 |
| 2014/0076508 | A1 * | 3/2014 | Mullet | E06B 9/72 160/310 |
| 2015/0107788 | A1 * | 4/2015 | Mullet | A47H 1/02 160/405 |
| 2015/0159430 | A1 * | 6/2015 | Huang | A47H 1/04 160/168.1 P |
| 2015/0272370 | A1 * | 10/2015 | Mullet | E06B 9/72 29/428 |
| 2015/0327705 | A1 * | 11/2015 | Mullet | A47H 23/01 160/331 |
| 2016/0032647 | A1 * | 2/2016 | Adreon | E06B 9/322 310/68 B |
| 2016/0143470 | A1 * | 5/2016 | Mullet | A47H 1/102 160/331 |
| 2017/0000280 | A1 * | 1/2017 | Mullet | A47H 1/02 |

FOREIGN PATENT DOCUMENTS

| | | |
|---|---|---|
| JP | 2006314389 | 11/2006 |
| JP | 2009034301 | 2/2009 |
| JP | 2011062497 | 3/2011 |
| KR | 100903201 | 6/2009 |
| KR | 20100006476 | 1/2010 |
| WO | 8602970 | 5/1986 |

OTHER PUBLICATIONS

European Search Report, EP13837043.2, PCT-US2013-060205, dated Jun. 27, 2016.

International Preliminary Report on Patentability, PCT/US2013/060205, dated Mar. 26, 2015.

International Search Report, PCT/US2014/045633, dated Nov. 7, 2014.

Written Opinion of the International Searching Authority, PCT/US2014/045663, dated Nov. 7, 2014.

* cited by examiner

MOTORIZED DRAPERY APPARATUS, SYSTEM AND METHOD OF USE

FIELD OF THE INVENTION

This invention relates to an architectural covering. More specifically, and without limitation, this invention relates to a motorized drapery apparatus, system and method of use.

BACKGROUND OF INVENTION

Architectural coverings, such as curtains, shades, draperies and the like are frequently used to provide privacy and to limit the amount of light that is permitted to pass through a window and into a room or building. There are countless types, forms and designs of architectural coverings known in the art. The term architectural covering is used to describe any and all of these types, forms and designs including blinds, shades, draperies, and the like.

One form of architectural covering of particular interest in this application is a drape or drapery product. Common components of draperies include a support rod connected to brackets positioned above or adjacent to a window or door. In one arrangement of a drapery product, the support rod rotates and drives the shade material across the length of the support rod. This arrangement is more fully described in Applicant's related provisional patent application Ser. No. 61/702,093 filed on Sep. 17, 2012 entitled Rotatable Drive Element For Moving A Window Covering, which was converted into a utility patent having patent application Ser. No. 14/029,210 filed on Sep. 16, 2013 with the same title as well as being filed as a PCT Application Serial No. PCT/US2013/060205 filed on Sep. 17, 2013 with the same title, which are all fully incorporated by reference herein, including any related applications; and Applicant's related patent Application Ser. No. 61/810,949 filed on Apr. 11, 2013 entitled Rotatable Drive Element For Moving A Window Covering Including A Flexible Guide Arm And A Pointed Tooth Arrangement which is also fully incorporated by reference herein, including any related applications; and Applicant's related provisional patent Application Ser. No. 61/856,123 filed on Jul. 19, 2013 entitled Motorized Grommet Drapery Apparatus, System And Method Of Use which is also fully incorporated by reference herein, including any related applications; and Applicant's related provisional patent Application Ser. No. 61/856,143 filed on Jul. 19, 2013 entitled Motorized Drapery Apparatus With Batteries Positioned In The Brackets which is also fully incorporated by reference herein, including any related applications; and Applicant's related provisional patent Application Ser. No. 61/901,985 filed on Nov. 8, 2013 entitled Method And Apparatus For Linked Horizontal Drapery Panels Having Varying Characteristics To Be Moved Independently By A Common Drive System which is also fully incorporated by reference herein, including any related applications.

In these related patent applications, the support rod, also referred to as the rotatable drive element, rotates in place. While the rotation of the rotatable drive element is effective for driving the shade material across the length of the rotatable drive element to open and close the architectural covering, this rotation produces its own problems. Namely, connecting the rotatable drive element to brackets produces challenges because the rotatable drive element can wear, rattle, move around and otherwise be difficult to connect to and hold in place. This arrangement also produces significant challenges when attempting to connect other members or devices to the rotatable drive element, such as finials, rotatable drive element extensions, or additional rotatable drive elements to extend the length of the architectural covering.

In addition to these problems, other problems exist in connecting motors to the rotatable drive element as motors positioned within the rotatable drive element present their own problems. Further problems exist in how to power architectural coverings having a rotatable drive element.

Thus it is a primary object of the invention to provide a motorized drapery apparatus, system and method of use that improves upon the state of the art.

Another object of the invention is to provide a motorized drapery apparatus, system and method of use that is easy to use.

Yet another object of the invention is to provide a motorized drapery apparatus, system and method of use that is efficient.

Another object of the invention is to provide a motorized drapery apparatus, system and method of use that is simple in design.

Yet another object of the invention is to provide a motorized drapery apparatus, system and method of use that is inexpensive.

Another object of the invention is to provide a motorized drapery apparatus, system and method of use that has a minimum number of parts.

Yet another object of the invention is to provide a motorized drapery apparatus, system and method of use that has an intuitive design.

Another object of the invention is to provide a motorized drapery apparatus, system and method of use that holds a rotatable drive element in place while allowing it to rotate.

Yet another object of the invention is to provide a motorized drapery apparatus, system and method of use that allows for connection of multiple rotatable drive elements.

Another object of the invention is to provide a motorized drapery apparatus, system and method of use that provides for connection of a battery assembly external of the rotatable drive element.

Yet another object of the invention is to provide a motorized drapery apparatus, system and method of use that allows for connection of multiple motor housings so as to provide additional torque for rotation.

Another object of the invention is to provide a motorized drapery apparatus, system and method of use that allows for connection of a motor housing that is external to the rotatable drive element.

Yet another object of the invention is to provide a motorized drapery apparatus, system and method of use that allows for connection of an external power supply through the bracket.

Another object of the invention is to provide a motorized drapery apparatus, system and method of use that provides for housing electronic components to control the system in a portion of the bracket.

These and other objects, features, or advantages of the present invention will become apparent from the specification and claims.

SUMMARY OF THE INVENTION

An architectural covering is presented having a rotatable drive element having a guide structure and a plurality of idler attachment elements and a drive element positioned over the rotatable drive element. The rotatable drive element is connected to a wall, ceiling or other structure by brackets. In one arrangement a drive shaft having at least one bearing is then attached to the brackets such that the rotatable drive elements rotate upon the bearings. This arrangement provides an efficient, simple and convenient manner of attaching a rotatable drive element to brackets for mounting.

DETAILED DESCRIPTION OF THE INVENTION

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the present inventions. The following detailed description is, therefore, not to be taken in a limiting sense, and the scope of the present invention is defined only by the appended claims, along with the full scope of equivalents to which such claims are entitled.

As used herein, the terminology such as vertical, horizontal, top, bottom, front, back, end and sides are referenced according to the views presented. It should be understood, however, that the terms are used only for purposes of description, and are not intended to be used as limitations. Accordingly, orientation of an object or a combination of objects may change without departing from the scope of the invention.

As used herein, the invention is shown and described as being used in association with an architectural covering however the invention is not so limiting. Instead, one of ordinary skill in the art will appreciate that the system and method presented herein can be applied to any mechanical device, without limitation. The system and method is merely shown and described as being used in association with an architectural covering for ease of description and as one of countless examples.

As used herein, the term architectural covering refers to any covering such as a blind, drapery, roller shade, venetian blind, drapery or the like, used especially in association with windows. This term is in no way meant to be limiting. Instead, one of ordinary skill in the art will appreciate that the system and method presented herein can be applied to any architectural covering, without limitation.

Figure 1:
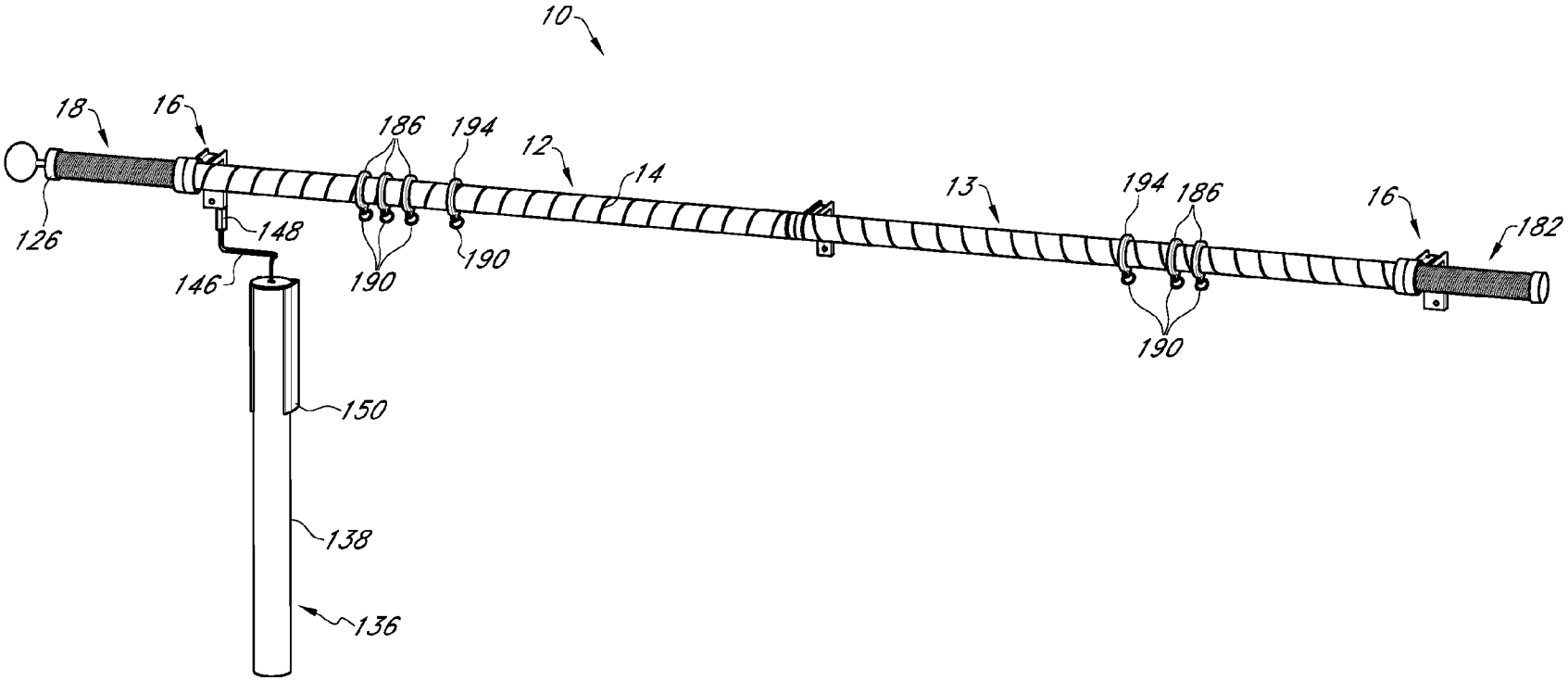
FIG. 1 is a perspective view of an architectural covering having two rotatable drive elements having a helical guide structure therein; the rotatable drive elements are connected at their inward ends by a center coupler; the rotatable drive elements are connected to a bracket at their outward ends, a motor housing with a finial is connected to one end of the rotatable drive element with a battery assembly electrically connected to the bracket adjacent the motor housing which supplies power to the motor housing; a dummy rotatable drive element extension is connected to the bracket on the opposite; driver attachment elements for driving shade material open and closed are shown on the rotatable drive element.

With reference to FIG. 1, an architectural covering 10 is presented. Architectural covering 10 is formed of any size, shape and design. As one example, as is shown, architectural covering 10 includes a first rotatable drive element 12 connected to a second rotatable drive element 13. The first and second rotatable drive elements 12, 13 are any form of a rotating member such as a rod, tube, threaded bar, or the like. In one arrangement, rotatable drive elements 12 and 13 are practically identical if not identical and therefore for simplicity reference to one shall be reference to the other, unless specified otherwise. In one arrangement, rotatable drive element 12 is an elongated hollow tube, having a helical guide structure 14 positioned in its surface, as is described in further detail in Applicant's related Application Ser. No. 61/702,093 filed on Sep. 17, 2012 entitled Rotatable Drive Element For Moving A Window Covering, which is fully incorporated by reference herein, including any related applications; and Applicant's related patent Application Ser. No. 61/810,949 filed on Apr. 11, 2013 entitled Rotatable Drive Element For Moving A Window Covering Including A Flexible Guide Arm And A Pointed Tooth Arrangement which is also fully incorporated by reference herein, including any related applications. The helical guide structure 14 can be a left-hand guide structure, a right-hand guide structure, or both, or a plurality or combination of left-hand guide structures and/or right-hand guide structures. Guide structure 14 can either be grooves, indentations, protrusions, threads or any other feature or the like. Guide structure 14 can either ground or machined into the surface or rotatable drive element 12, knurled into the surface of rotatable drive element 12 (as is described further herein), cast or formed into the surface of rotatable drive element 12, or created by any other means or methods known in the art.

Wall brackets 16 support rotatable drive element 12. Wall brackets 16 are any form of a connecting device which supports and connects rotatable drive element 12 to any structural element such as a wall adjacent a window, a ceiling, a frame structure or the like. As one example, in the arrangement shown, rotatable drive element 12 connects on one side to wall bracket 16 and a motor housing 18 connects on the opposite side.

In the arrangement shown, wall brackets 16 include a mounting plate 20 which connects to the wall, an extension arm 22, which extends between mounting plate 20 and a mounting member 24. Mounting member 24 is formed of any suitable size and shape and serves to connect to rotatable drive element 12 while allowing for functional movement, such as rotation, of the necessary parts. In one arrangement, as is shown, mounting member 24 is a generally circular collar which is sized and shaped to receive rotatable drive element 12 therein as is described further herein.

Mounting member 24 has an exterior side 26 and an interior side 28. Rotatable drive element 12 connects to the interior side 28 and motor housing 18 connects to the exterior side 28. A collar 30 extends inwardly from the mounting member 24 thereby separating the interior side 28 from the exterior side 26. In the arrangement shown, collar 30 has a flat and flush interior side 32 which extends into the open interior of mounting member 24 perpendicularly to the interior surface of mounting member 24. The exterior side of collar 30 has a protrusion 34 that extends outwardly from collar 30 in perpendicular alignment to collar 30 and in parallel spaced alignment to the interior surface of mounting member 24 thereby forming channel 36 between the interior surface of mounting member 24 and the exterior surface of protrusion 34. A step 38 is positioned between protrusion 34 and the end 40 of collar 30 which defines a circular interior through hole. Step 38 and channel 36 serve to engage and hold motor housing 18 while allowing portions of the motor housing 18 to extend through the open end 40 of collar 30 to engage and rotate rotatable drive element 12.

As is shown, the features of the interior side 32 of mounting member 24 are generally circular in shape so as to allow rotation of rotatable drive element 12. In contrast, key-features 42 are positioned in the exterior side 26 of mounting member 24. Key-features 42 are any aberration, deviation, irregularity, anomaly in the round features in the exterior side 26 of mounting member 24. Key-features 42 breakup the circular shape of the features in the exterior side 26 of mounting member 24 and thereby serve to prevent rotation of motor housing 18 when connected to bracket 16. In the arrangement shown, key-features 42 include a pair of semi-circular recesses in the mounting member 24 that extend all the way to the collar 30. A divider 46 extends partially between the two recesses 44 and provides separation thereto. Divider 46 is positioned in alignment with the center of extension arm 22 for added strength and ease of alignment.

Electrical contacts 48 are positioned in the key-features 32 at approximately the center of each recess 44 and extend outwardly from the exterior surface of collar 30 within channel 36. In the arrangement shown, electrical contacts 48 are circular spring loaded conductive plungers, however any other form of an electrical contact is hereby contemplated for use. Electrical contacts 48 are electrically connected to a conduit 50 which extends through a passageway 54 in extension arm 22 of bracket 16 and through a passageway 56 in mounting plate 20. Passageway 56 in mounting plate 20 is to the side of and intentionally separated from upper through hole 58 and lower through hole 60 so as to prevent conduit 50 from being damaged when mounting bracket 16. Through holes 58, 60 receive fasteners 62 (not shown), such as conventional screws which are used to attach brackets 16 to a wall, ceiling or other mounting structure. In the arrangement shown, the lower through hole 60 is positioned approximately in the lateral middle of mounting plate 20 whereas the upper through hole 58 is positioned laterally to one side of the mounting plate 20. This offset provides advantages during mounting, namely, a fastener 62 can be inserted in the bottom through hole 60 and then the bracket 16 can be rotated on the lower fastener 62 into place followed by a fastener 62 into the upper through hole 58 to complete installation.

The lower end of conduit 50 is connected to a socket assembly 64. Socket assembly 64 is any form of an electrical connector such as a USB port, a two-conductor socket, a three conductor socket, a four conductor socket, a five conductor socket, a six conductor socket, a phone jack, an Ethernet socket, or any other standard or non-standard socket used to connect conduit 50 to any other device or object electrically.

A components recess 66 is positioned in mounting plate 20 which is sized and shaped to receive a motor controller assembly 68, which is described further herein. Components recess 66 is formed of any suitable size, shape and design. As one example, in the arrangement shown, components recess 66 is positioned between the sidewalls 67 and front wall 69 of mounting plate 20 and positioned adjacent to the through holes 58, 60.

Motor Housing:

Motor housing 18 is connected adjacent the exterior end of rotatable drive element 12. Motor housing 18 is connected to the exterior side 26 of mounting member 24 of bracket 16. Motor housing 18 is formed of any suitable size and shape. In one arrangement, as is shown, motor housing 18 is formed of a hollow tube 70 which is formed as an extension of rotatable drive element 12 and with approximately the same exterior size, shape, diameter and appearance of the rotatable drive element 12, as well as continuous extension of guide structure 14 therein. In this arrangement, when motor housing 18 is connected to the end of rotatable drive element 12, the length of rotatable drive element 12 is relatively seamlessly extended as is the length of guide structure 14. In one arrangement, as is shown, rotatable drive element 12 connects to the interior side 28 of mounting member 24. In this arrangement, mounting member 24 hides or covers the seam between rotatable drive element 12 and motor housing 18. In this arrangement, the motor housing 18 remains stationary as rotatable drive element 12 rotates, as is further described herein.

Motor housing 18 has an exterior end 72 and an interior end 74. Positioned within the open interior compartment of hollow tube 70 between interior end 74 and exterior end 74 is a motor 76. Motor 76 is any form of a motor that converts electrical energy to mechanical energy and provides rotation and torque. In the arrangement shown, motor 76 is connected to a transmission 78. Transmission 78 is any form of a device that transmits rotation of motor 76 and gears it such as a gear box, a planetary gear box or the like. Transmission 78 transmits the rotation of motor 76 and converts into the desirable speed useful for the application. The transmission 78 helps to maximize the torque produced by the motor 76 while maximizing battery life by reducing or minimizing power draw.

Transmission 78 is connected to a drive shaft 80 which extends outwardly from the interior end 74 of motor housing 18. Drive shaft 80 extends through motor end cap 82 which is connected to the interior end 74 of hollow tube 70.

Motor end cap 82 has a generally circular external ring 84 having an interior edge 86 and an exterior edge 88. Interior edge 86 connects to hollow tube 70 whereas the exterior edge 88 connects to mounting member 24 of bracket 16. A collar 90 extends inwardly from the ring 84 thereby separating the interior side 86 from the exterior side 88 and provides a mounting surface for mounting motor end cap 82 to the other components of motor housing 18. An opening 92 positioned in the collar 90 allows for the drive shaft 80 of transmission 78 to extend from the interior side 86 of motor end cap 82 to the exterior side 88 of motor end cap 82.

Key-features 94 are positioned in the exterior surface of motor end cap 82. Key-features 94 are any aberration, deviation, irregularity, anomaly in the generally round exterior surface of ring 84 of motor end cap 82. Key-features 94 breakup the circular shape of the motor end cap 82 and thereby serve to prevent rotation of motor housing 18 when connected to bracket 16. In the arrangement shown, key-features 94 include a pair of semi-circular protrusions that connect to one another. Key-features 94 extend from the exterior edge 88 of ring 84 to the collar 90 of motor end cap 82. A divider 96 extends partially between the two semi-circular protrusions and provides separation thereto. Divider 96 is positioned in alignment with the center of extension arm 22 for added strength and ease of alignment.

Electrical contacts 98 are positioned in the key-features 94 at approximately the center of each semi-circular protrusion, on the interior side of ring 84. Electrical contacts 98 extend outwardly from the exterior surface 88 of collar 90, Electrical contacts 98 are connected to electrical connectors 99 which extend through the motor end cap 82 and transmit the power received by electrical contacts 98 to the electrical components contained within motor housing 18. In the arrangement shown, electrical contacts 98 are circular spring loaded conductive plungers, however any other form of an electrical contact is hereby contemplated. Electrical contacts 98 are electrically connected to the motor 76 and motor controller assembly 68 as is described herein.

In the arrangement shown, a pair of fasteners 100 extend through the collar 90 and connect to the transmission 78, or any other component of the motor housing 18, thereby locking the two components together. A bearing 102 and motor coupler 104 is positioned over the drive shaft 80 held in place by a locking arrangement between motor coupler 104 connects and drive shaft 80. Motor coupler 104 has a rounded or angled nose 106 which tapers outwardly as it extends towards motor housing 18. The exterior periphery of motor coupler 104 adjacent motor housing 18 is formed in the shape of gears 108 or a gear tooth arrangement. That is, the external surface of motor coupler 104 near its base where motor coupler 104 connects to the motor housing 18. The gears 108 mesh with gears in or attached to the rotatable drive element 12 and serve to rotate rotatable drive element 12 when motor 76 and/or transmission 78 is rotated. The rounded or angled nose 106 eases alignment and insertion of the motor coupler 104 through bracket 16 and into the rotatable drive element 12. A shoulder 110 is positioned towards the motor housing 18 from gears 108 and nose 106 and extends outwardly past gears 108. Shoulder 110 serves as a stop for bearing 102 which is positioned around body 112 and held in place by clip 114.

In this arrangement, as motor 76 rotates, the drive shaft 80 of transmission 78 rotates which rotates motor coupler 104 which rotates bearing 102 within ring 84 of motor end cap 82.

The exterior end 72 of motor 76 is connected to a motor controller 68 (or in an alternative arrangement, the motor controller 68, or a portion of motor controller 68 is positioned in or connected to first bracket 16). Motor controller 68 includes all the components to control motor 76 and to control operation of the architectural covering 10. Motor controller 68 is any device which controls the operation of motor 76. In one arrangement, motor controller 68 is an electrical circuit board or PC board 116 which is electrically connected to a microprocessor 118 connected to memory 120, a receiver or transceiver 122 and an antenna 124. Microprocessor 118 is any programmable device that accepts analog or digital signals or data as input, processes it according to instructions stored in its memory 120, and provides results as output. Microprocessor 118 receives signals from receiver or transceiver 122 and processes them according to its instructions stored in its memory 120 and then controls motor 76 based on these signals. Memory 120 is any form of electronic memory such as a hard drive, flash, ram or the like. Antenna 124 is any electronic device which converts electric power into electromagnetic signals or electromagnetic waves, which are commonly known as radio waves or RF (radio frequency) (hereinafter collectively referred to as "electromagnetic signals" without limitation). Antenna 124 can transmit and/or receive these electromagnetic signals. In one arrangement these electromagnetic signals are transmitted via AM or FM RF communication, while any other range of RF is hereby contemplated such as 433 MHz or 908 MHz. In the arrangement shown, a meandering monopole antenna or fractal antenna is used; however any other form of an antenna is hereby contemplated. Antenna 124 is positioned adjacent the exterior end 72 of motor housing 18 so as to be in the best position to receive electromagnetic signals without interference. In the arrangement shown, antenna 124 is positioned just inside of end cap 126. In an alternative arrangement, antenna 124 is incorporated within end cap 126. In another arrangement end cap 126 is replaced with a decorative finial; or alternatively a decorative finial is connected to end cap 126.

To detect rotation and track the position of rotatable drive element 12, a sensor assembly 128 is connected to motor housing 18. Sensor assembly 128 is any form of a device which senses the rotation or position of architectural covering 10, such as reed switches, mechanical encoders, magnetic encoders, or the like. In one arrangement, as is shown, sensor assembly 128 includes a magnet wheel 130 connected to a secondary motor shaft 132 extending outwardly from the exterior end 72 of motor 76 such that when motor 76 rotates, secondary motor shaft 132 rotates, thereby rotating magnetic wheel 130. Positioned adjacent to magnet 130 is at least one, and as is shown two, Hall Effect sensors 134 positioned opposite one another. In this arrangement, Hall Effect sensors 134 are connected to PC board 116 adjacent magnet 130 which extends into an opening in PC board 116. This arrangement using Hall Effect Sensors 134 is more fully described in Applicant's related patent application entitled Low-Power Architectural Covering Ser. No. 61/811,650 filed on Apr. 12, 2013 which is fully incorporated by reference herein.

Battery Tube Assembly:

A battery tube assembly 136 is connected to the architectural covering 10. Battery Tube Assembly 136 is formed of any suitable size, shape and design. As one example, in the arrangement shown, the battery tube assembly 136 includes an elongated hollow tubular member 138 which is sized and shaped to receive a stack of conventional batteries 140 therein within close and acceptable tolerances such as A, AA, B, C or D cell batteries. The lower end of battery tube assembly 136 is closed by a battery end cap 142. The opposite, or upper end of battery tube assembly 136 is removeably and replaceably enclosed by a battery connector cap 144. Battery connector cap 144 is removeably and replaceably connected to battery tube assembly 136 by a key-slot 146 positioned in the elongated hollow tubular member which is in locking and mating communication with a protrusion in the battery connector cap 144. However, any other means of connecting battery connector cap 144 to elongated hollow tubular member 138 is hereby contemplated such as threads, a snap fit design, a button-lock design or the like. A transmission wire 146 which terminates in a plug 148 extends outwardly from battery connector cap 144 and transmits electricity to architectural covering 10. Plug 148 matingly and matchingly and removeably and replaceably connects to socket assembly 64 in mounting plate 20 of bracket 16.

A battery tube mounting bracket 150 is removeably and replaceably connected to the elongated hollow tubular member 138 and serves to mount and hold elongated hollow tubular member 138 therein. Battery tube mounting bracket 150 is formed of any suitable size, shape and design. As one example, in the arrangement shown, battery tube mounting bracket 150 is a generally elongated extrusion having a back wall 152 connected to its outward edges to sidewalls 154. The space between back wall 152 and opposing sidewalls 154 is sized and shaped to frictionally and tightly, but removeably, receive hollow elongated tubular member 138. To achieve this frictional engagement, the ends 156 sidewalls 154 angle or curve inward toward one another. In this arrangement, elongated hollow tubular member 138 can be forced within the space between sidewalls 154 and back wall 152; and elongated hollow tubular member 138 can be forced out of the space between sidewalls 154 and back wall 152. Elongated hollow tubular member 138 can be mounted within the vicinity of bracket 16 and motor housing 18 in either a vertical alignment (as is shown) in a perpendiculars alignment or in any other alignment by fastening battery tube mounting member 150 to the wall, ceiling or structure architectural covering 10 is mounted to. Mounting can be accomplished by passing conventional fasteners, such as screws or bolts, through the back wall 152 of battery tube mounting bracket 150.

Motor Coupler Sleeve:

Rotatable drive element 12 connects to the motor housing 18 through connection of the motor coupler 104 to a motor coupler sleeve 160. Motor coupler sleeve 160 is an elongated hollow tubular member having an exterior surface 162 and an interior surface 164 which extend in generally parallel spaced relation to one another. The exterior surface 162 has gears or teeth therein that extend along a length of motor coupler sleeve 160. The gears or teeth in the exterior surface 162 of motor coupler sleeve 160 matingly and meshingly and removeably and replaceably engage and receive gears or teeth in the interior surface 166 of rotatable drive element 12 adjacent its open hollow end 168. A collar 170, or protrusion positioned in the exterior surface 162 of motor coupler sleeve 160 sets the distance at which motor coupler sleeve 160 can be inserted into the end 168 of rotatable drive element 12.

The interior surface 164 of motor coupler sleeve 160 also has gears or teeth therein that extend along a length of motor coupler sleeve 160. The gears or teeth in the interior surface 164 of motor coupler sleeve 160 matingly and meshingly and removeably and replaceably engage and receive gears 108 in the interior surface of motor copuler 104 of motor housing 18. In this arrangement, nose 106 of motor coupler 104 is inserted through the mounting member 24 of bracket 16 and into the hollow interior of motor coupler sleeve 160 such that the gears 108 of motor coupler 104 engage the teeth or gears in the interior surface 164 of motor coupler sleeve 160. A collar 170, or protrusion positioned in the exterior surface 162 of motor coupler sleeve 160 sets the distance at which motor coupler sleeve 160 can be inserted into the end 168 of rotatable drive element 12.

When motor coupler sleeve 160 is fully inserted within the hollow interior end 168 of rotatable drive element 12 and the motor coupler 104 is fully inserted into the hollow interior of motor coupler sleeve 160, rotation of motor coupler 104 causes rotation of rotatable drive element 12.

Center Coupler:

Two rotatable drive elements 12 can connect to one another in end-to-end alignment through the use of a center coupler 172. The use of multiple center couplers 172 can be used to connect two, three, four or more rotatable drive elements 12 together without limit.

Center coupler 172 is formed of any suitable size, shape and design. As one example, in the arrangement shown, center coupler 172 is a pair of elongated hollow tubular members 174 (otherwise known as splines, or when combined as a single piece as a spline) connected at their inward facing edge to a bearing assembly 176. In one arrangement, bearing assembly 176 includes an individual bearing 178 associated with each elongated hollow tubular member 174. The exterior surface 180 of each elongated hollow tubular member 174 has gears or teeth therein that extend along a length of each elongated hollow tubular member 174. The gears or teeth in the exterior surface 180 of elongated hollow tubular member 174 matingly and meshingly and removeably and replaceably engage and receive gears or teeth in the interior surface 166 of rotatable drive element 12 adjacent its open hollow end 168.

In one arrangement, bearing assembly 176 allows for free and independent rotation of each elongated hollow tubular member 174 of center coupler 172 without affecting the other. This allows for rotation of two rotatable drive elements 12 free and independent of one another. This allows for individual control and operation of one side of architectural covering 10, such as when two motor housings 18 are associated with a two rotatable drive element 12 architectural covering 10, where each motor housing 18 controls only the rotatable drive element 12 it is connected to.

In an alternative arrangement, the two elongated hollow tubular members 174 are connected to one another, or only a single elongated hollow tubular member 174 is used. In this arrangement, the rotatable drive elements 12 do not rotate independently of one another. When two motor housings 18 are used with this arrangement, additional torque is provided by the combined force of two motors 76.

In one arrangement, the elongated hollow tubular members 174 are inserted all the way into the open ends 168 of rotatable drive elements until the ends 168 engage or approximately engage the bearing assembly 176. In this arrangement, rotatable drive elements are fully inserted over center coupler 172. In one arrangement, when fully inserted into opposing rotatable drive elements 12 no further support is necessary. In an alternative arrangement, center coupler 172 is connected to a bracket 16. That is, the bearing assembly 176 is held within the mounting member 20 of a bracket 16. When bearing assembly 176 is positioned within mounting member 20 of a bracket 16, rotatable drive elements 12 are free to rotate upon bearings 178. In this way, additional support is provided while still allowing for necessary rotation.

The center coupler 172 provides for easier installation by allowing the assembly of long rotatable drive elements 12 from shorter rotatable drive elements 12. This also reduces the cost and ease of shipping. In addition, in one arrangement, elongated hollow tubular members 174 of the center coupler 172 are formed of a material that has some bend to it. Suitable materials include plastic, rubber, composite UHMW material or the like. The benefits of this material, used in association with the hollow design of the tubular members 174 allow the center coupler 172 to provide some give to the two rotatable drive elements 12. This give or ability to slightly bend allows for the combined rotatable drive elements 12 to be installed on walls or in applications that are not exactly perfectly straight, or allows for less-precise alignment during installation. In one arrangement, motor coupler sleeve 160 is also made of the same material which allows for less-precise installation of motor housing 18 into motor coupler sleeve 160. The use of one of these plastic or composite materials also serves to reduce noise of the architectural covering 10 during use.

Multiple center couplers 170 can be used to connect any number of rotatable drive elements together.

Rotatable Drive Element Extension:

In the arrangement shown in FIG. 1, only a single motor housing 18 is connected to the two rotatable drive elements 12, which drives the combined rotatable drive elements 12. A rotatable drive element extension 182 is connected to the exterior side 26 of the mounting member 14 of the second bracket 16. Rotatable drive element extension 182 is formed of any suitable size, shape and design. As one example, in the arrangement shown, rotatable drive element extension 182 is simply a dummy motor housing lacking the internal drive components such as the motor 76, transmission 78 and motor controller assembly 68 and the like. In one arrangement, in all other ways, rotatable drive element extension 182 has an identical appearance and design to motor housing 18 described herein. In one arrangement, rotatable drive element extensions 182 do include the hollow tube, motor end cap 82, bearing 102 and motor coupler 104 so as to connect rotatable drive element 12 and allow rotation thereof. Motor housing 18 and rotatable drive element extension 182 are secured to brackets 16 by a locking-screw 184 which extends through mounting member 24 and engages the motor end cap 82 of motor housing 18 or rotatable drive element extension 182 after installation. Locking-screw 184 prevents the motor housing 18 or the rotatable drive element extension 182 from falling out of bracket 16. In this way, the end 168 of rotatable drive element 12 connected to the motor housing 18 is identified as the motor-side; whereas the end 168 of rotatable drive element 12 connected to the rotatable drive element extension 182 is identified as the non-motor side.

Idler Attachment Elements:

Idler attachment elements 186 are connected to and positioned around rotatable drive element 12. Idler attachment elements 186 are formed of any suitable size and shape. In one arrangement, as is shown, idler attachment elements 186 are formed of a circular hoop member 188 which is sized and shaped to fit loosely around rotatable drive element 12. In one arrangement, a mounting ring 190 is connected to the circular hoop member 188 for attachment of shade material 192 which hangs down from idler attachment elements 186 and drive attachment elements 194.

Drive Attachment Elements:

Drive attachment elements 194, like idler attachment elements 186 are connected to and positioned around rotatable drive element 12. A single drive attachment elements 194 is positioned outside of, or at the end of the row of idler attachment elements 186, Drive attachment element 194 is formed of any suitable size, shape and design. In one arrangement, as is shown, drive attachment element 194 has a generally circular shape fit over and receives rotatable drive element 12 with a tooth engaged in the guide structure 14 such that when the rotatable drive element 12 rotates the drive attachment element 194 is driven along the length of rotatable drive element 12.

The idler attachment elements 186 and the driver attachment elements 194 are more fully described in applicant's related patent application Ser. No. 61/810,949 entitled Rotatable Drive Element For Moving A Window Covering Including A Flexible Guide Arm And A Pointed Tooth Arrangement filed on Apr. 11, 2013 which is fully incorporated by reference herein along with any related patent applications.

Assembly:

The architectural covering 10 is assembled by connecting the opposing rotatable drive elements 12 by fully inserting the elongated hollow tubular members 174 of center coupler 172 into the open end 168 of each rotatable drive element 12 until each bearing 178 is adjacent the end 168 of rotatable drive element 12, Bearing assembly 176 may or may not be connected to a mounting member 24 of a center bracket 16 to provide additional support at the middle of combined rotatable drive element 12. In addition, motor coupler sleeves 160 are fully inserted in the open outward ends 168 of rotatable drive elements 12 until collar 170 engages the end 168 of each rotatable drive element 12.

Once the two rotatable drive elements 12 are combined and assembled, the location of the non-motor side bracket 16 of the architectural covering 10 is established by aligning the center of center coupler 172 with the center of the window or other structure architectural covering 10 is intended to cover. Alternatively, by the location of the bracket 16 of the non-motor end of the architectural covering 10 is established by measuring from the center of the desired application outwardly based on the length of the rotatable drive element 12. Once the location of bracket 16 of the non-motor end of the architectural covering 10 is located, the rotatable drive element 12 is removed and the non-motor side bracket 16 is installed with a fastener 62 inserted through the through holes 60, 62.

Once the non-motor side bracket 16 is installed, using the combined rotatable drive element 12 as a guide, the location of the motor-side bracket 16 is established. This is accomplished by inserting the end 168 of the non-motor side of drive element 12 into the recess of the interior side 28 of non-motor side bracket 16. Next, the recess of the interior side 28 of motor-side bracket 16 is installed over the motor-side end of rotatable drive element 12. In this way the position of the motor-side bracket 16 is located and the rotatable drive element 12 is removed to allow for installation of the second bracket 16.

Once the location of the motor-side bracket 16 is established, a fastener 62 is inserted into the lower through hole 60 of mounting plate 20, also known as the cantilever hole. Once the lower fastener 62 is inserted into the second bracket 16, the bracket 16 can rotate or cantilever thereon. Next, the non-motor end 168 of rotatable drive element 12 is again inserted into the non-motor side bracket 16. Next, the motor-side end of the rotatable drive element 12 is aligned with and inserted into the mounting member 24 of motor-side bracket 16 by rotating bracket 16 upon fastener 62. Once the motor-side bracket 16 is aligned with the rotatable drive element 12, the second fastener 62 is fastened into through hole 58 and thereby the installation of the opposing brackets 16 is complete.

Next the motor housing 18 and rotatable drive element extension 182 are connected to the exterior sides 26 of mounting members 24 of brackets 16. This is accomplished by aligning the key features 94 in the motor housing 18 and rotatable drive element extension 182 with the key features 42 of brackets 16. Once aligned, the motor housing 18 and rotatable drive element extension 182 are forced into tight frictional engagement with brackets 16 with the key-features 42, 94 in mating alignment and engagement with one another. In this position, the electrical contacts 98 of motor housing 18 are in electrical engagement with the electrical contacts 48 of motor-side bracket 16. Once the motor housing 18 and rotatable drive element extension 182 are fully inserted into or onto brackets 16, locking-screw 184 is tightened thereby ensuring motor housing 18 and rotatable drive element extension 182 do not accidently separate from bracket 16.

Next, battery tube assembly 136 is installed by fastening battery tube mounting bracket 150 to a wall, ceiling or other structure, preferably behind the stack of shade material adjacent the motor-side bracket 16. Once the bracket 150 is installed, the elongated tube 138 is forced into the bracket 150 and the plug 148 is engaged into the socket assembly 64 thereby electrically connecting the power of batteries 140 to the components of motor housing 18.

Figure 2:
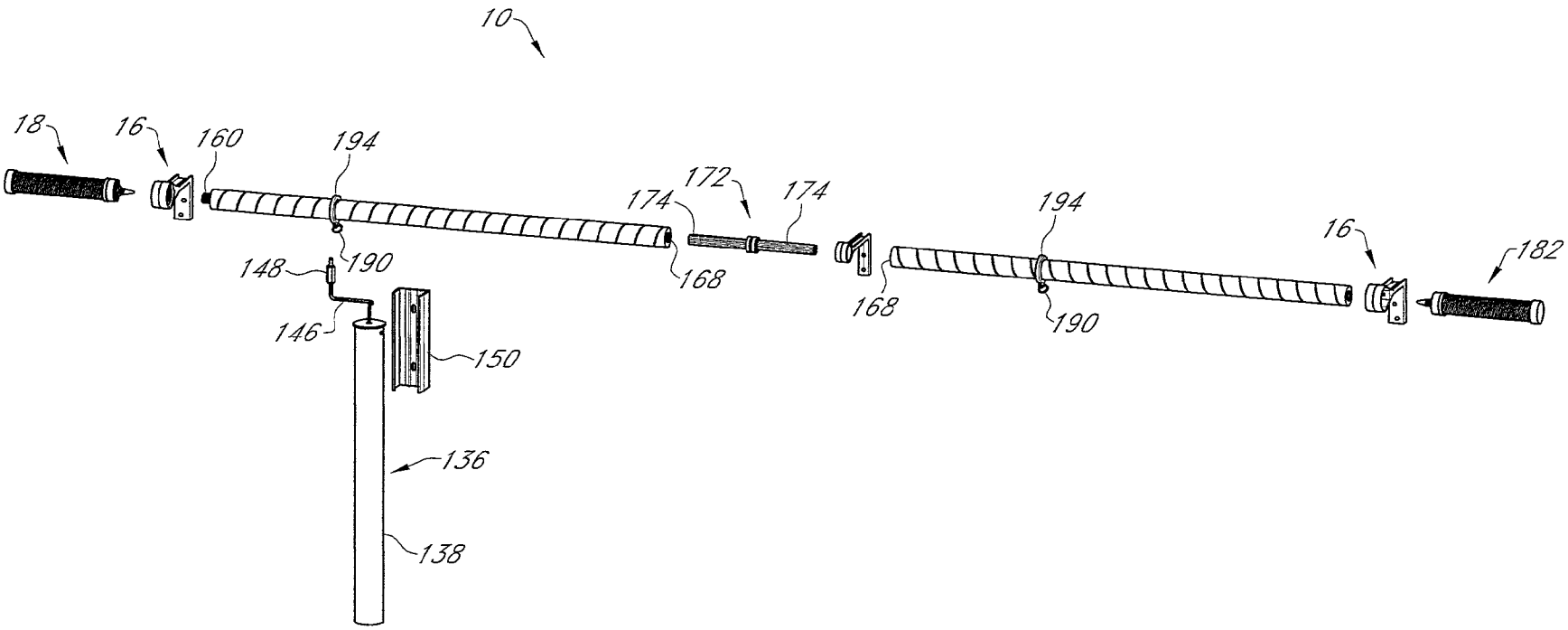
FIG. 2 is a perspective exploded view of the elements shown in FIG. 1
Figure 3:
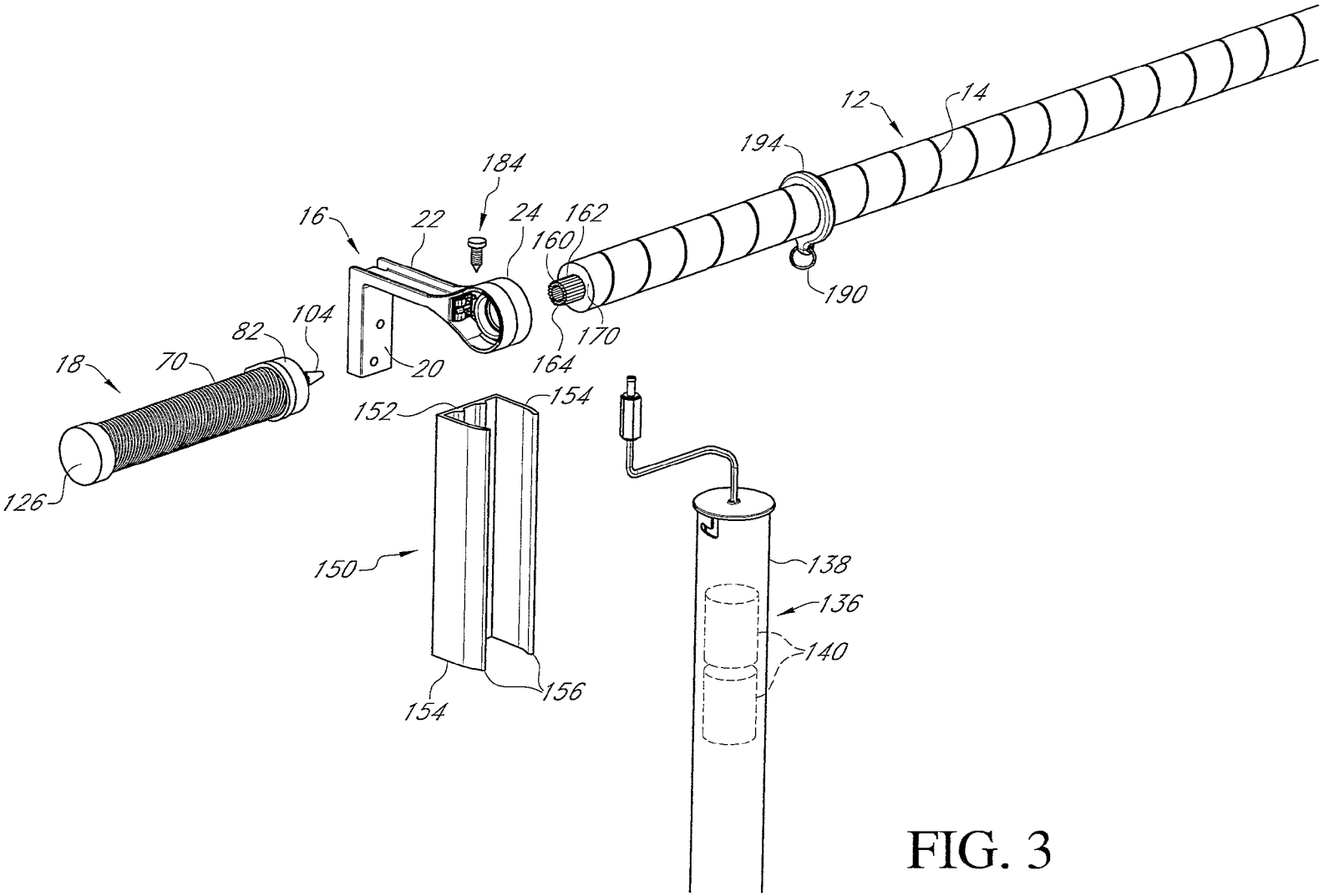
FIG. 3 is a close-up perspective exploded view of FIG. 2 showing the motor housing, bracket having a key feature and electrical contacts, a motor coupler sleeve positioned within the outward end of the rotatable drive element.
Figure 4:
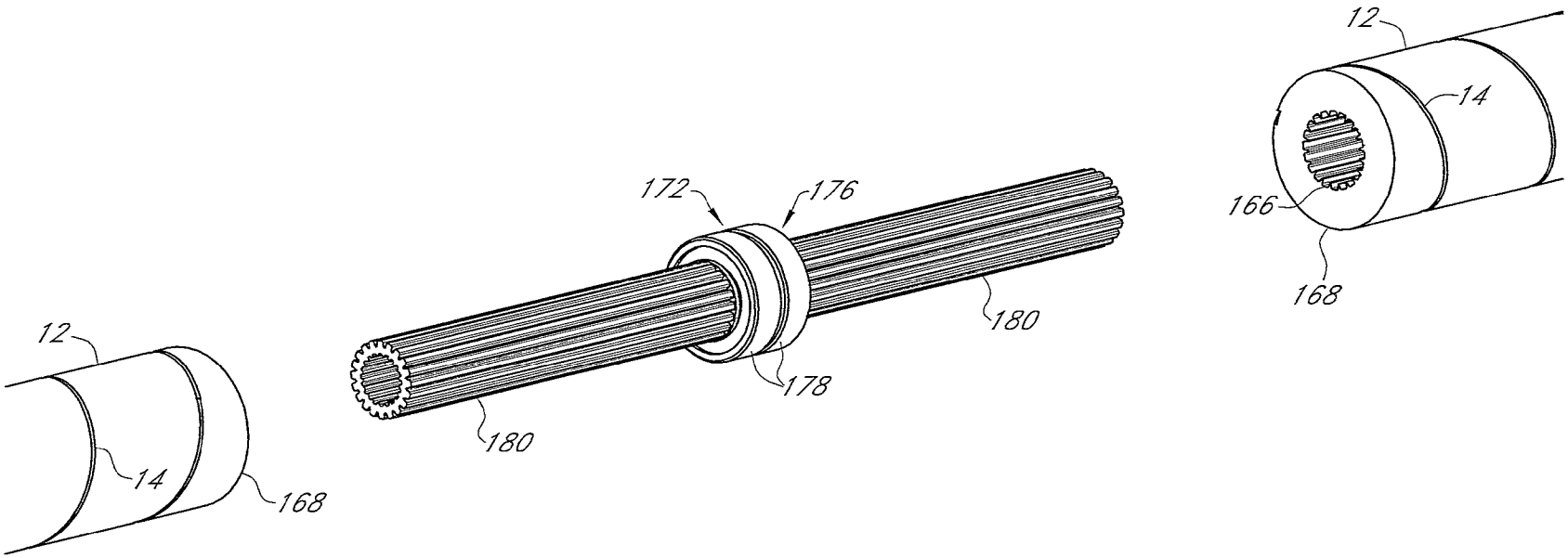
FIG. 4 is a close-up perspective exploded view of FIG. 2 showing the center coupler and the ends of rotatable drive elements.
Figure 5:
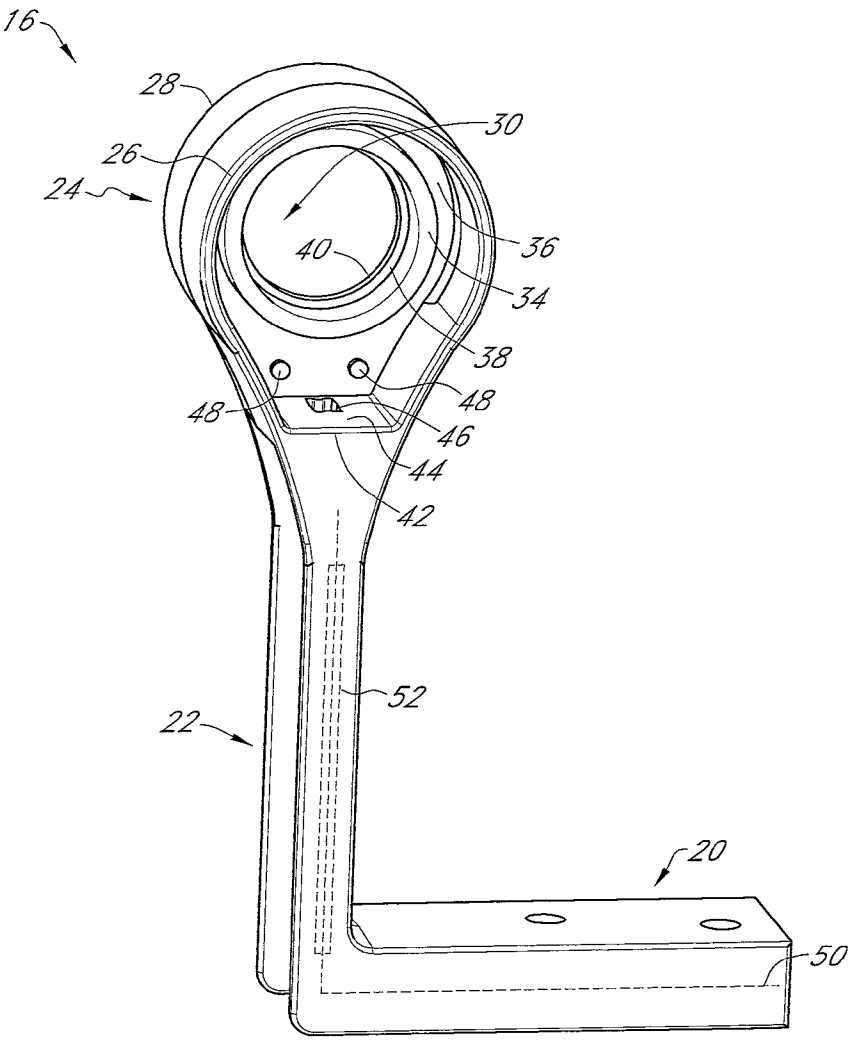
FIG. 5 is a close-up perspective view of a bracket which connects a motor housing to a rotatable drive element, the view showing the side which engages a motor housing, the view showing the key feature and the electrical contacts.
Figure 6:
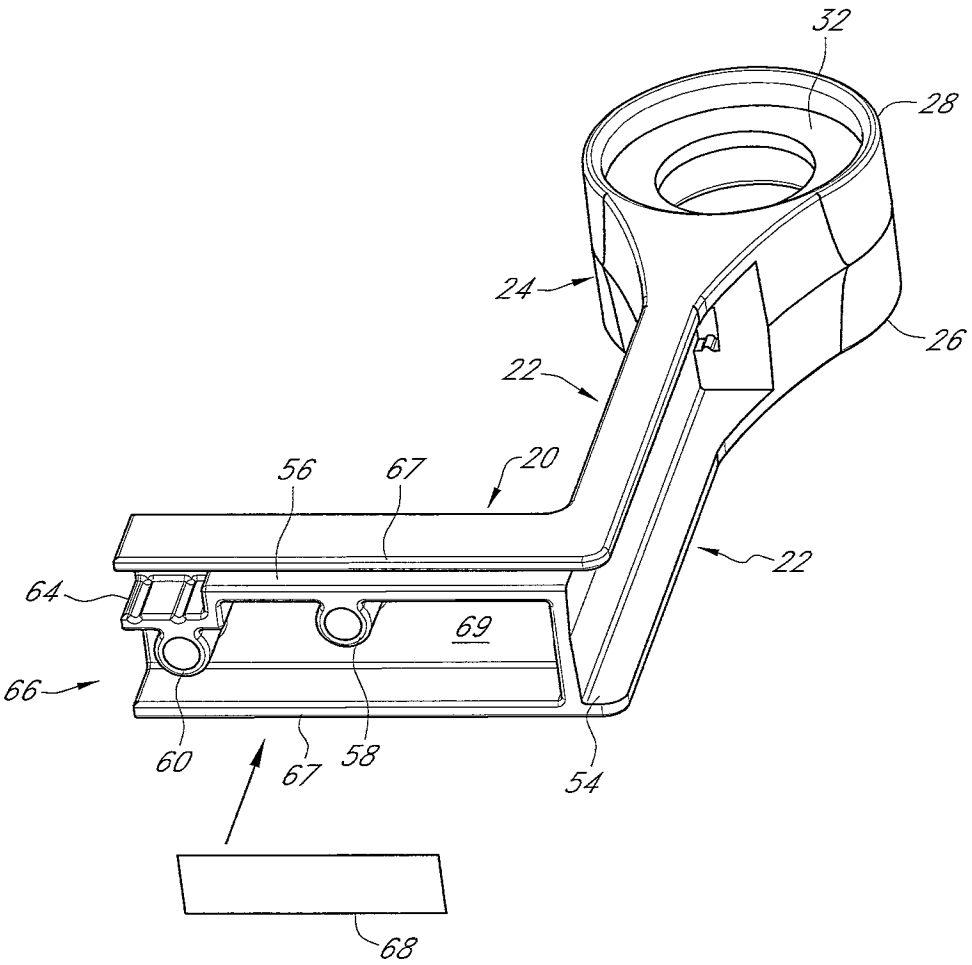
FIG. 6 is a close-up perspective view of a bracket which connects a motor housing to a rotatable drive element, the view showing the side of the bracket which engages a rotatable drive element, the view also showing the electrical socket and passageway, as well as a cavity which provides a spot for mounting and housing electronics for controlling the motor housing.
Figure 7:
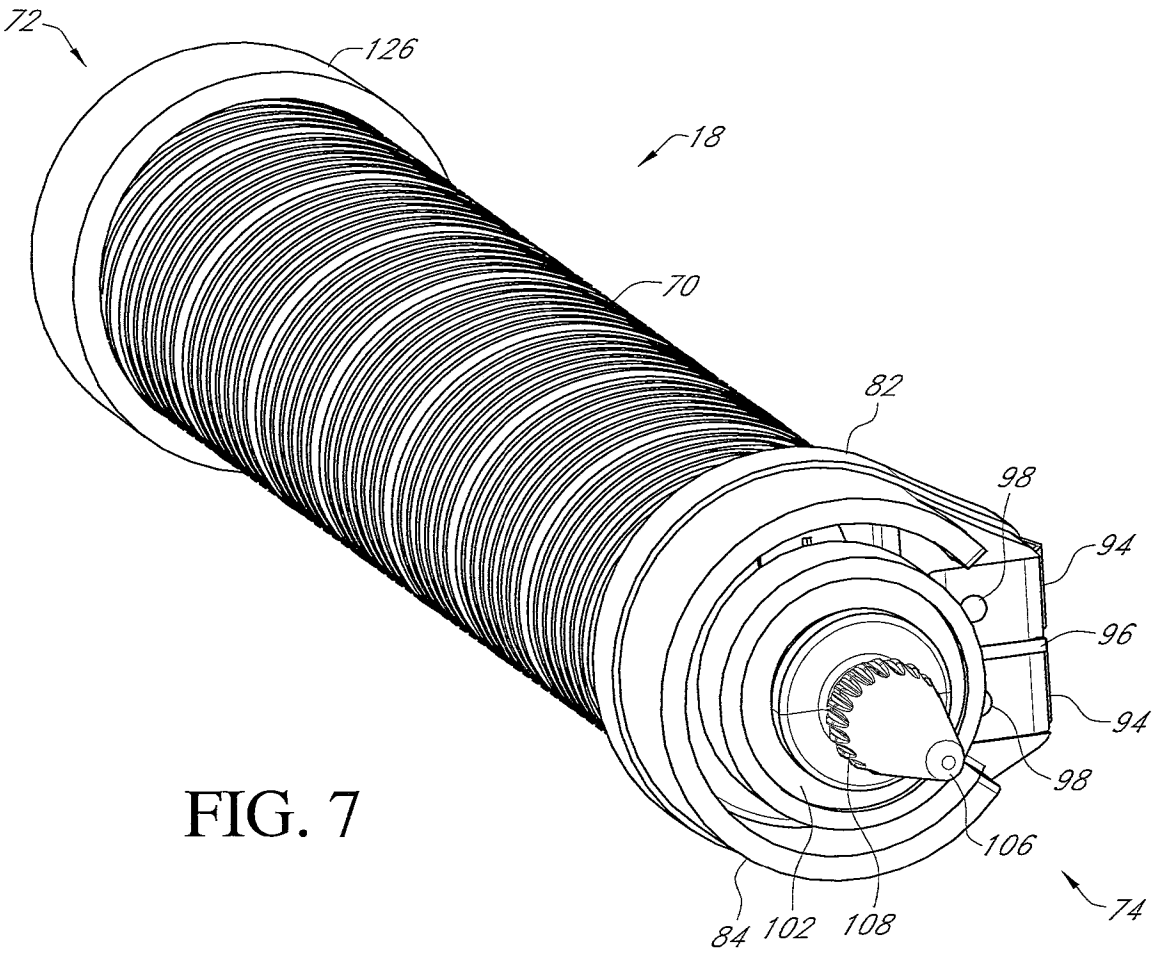
FIG. 7 is a close up perspective exploded view of a motor housing showing a threaded surface structure, an exterior end cap, a bearing a motor coupler a motor end cap and a key feature having electrical contacts.
Figure 8:
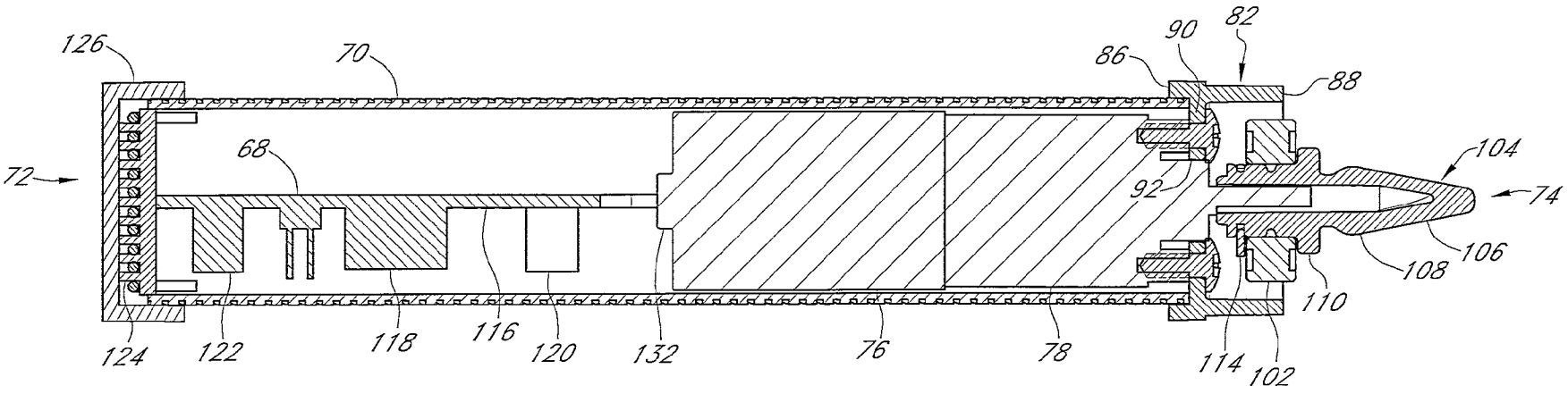
FIG. 8 is side elevation cut-away view of the motor housing shown in FIG. 7, the view showing the motor coupler, bearing, planetary gear box, electrical motor, sensor assembly, motor controller assembly, and antenna.
Figure 9:
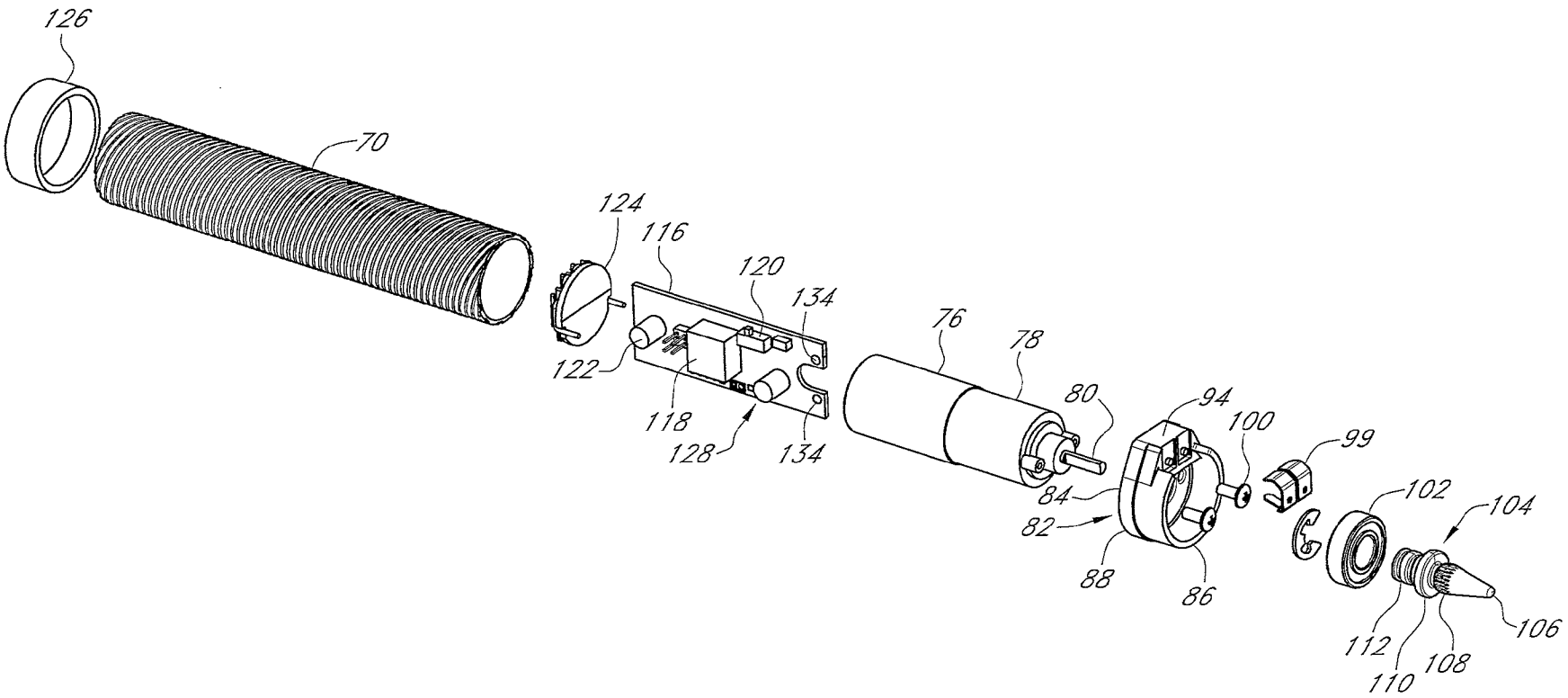
FIG. 9 is an exploded perspective view of the motor housing shown in FIG. 7, the view showing the motor coupler, bearing, planetary gear box, electrical motor, sensor assembly, motor controller assembly, antenna motor end cap and exterior end cap.
Figure 10:
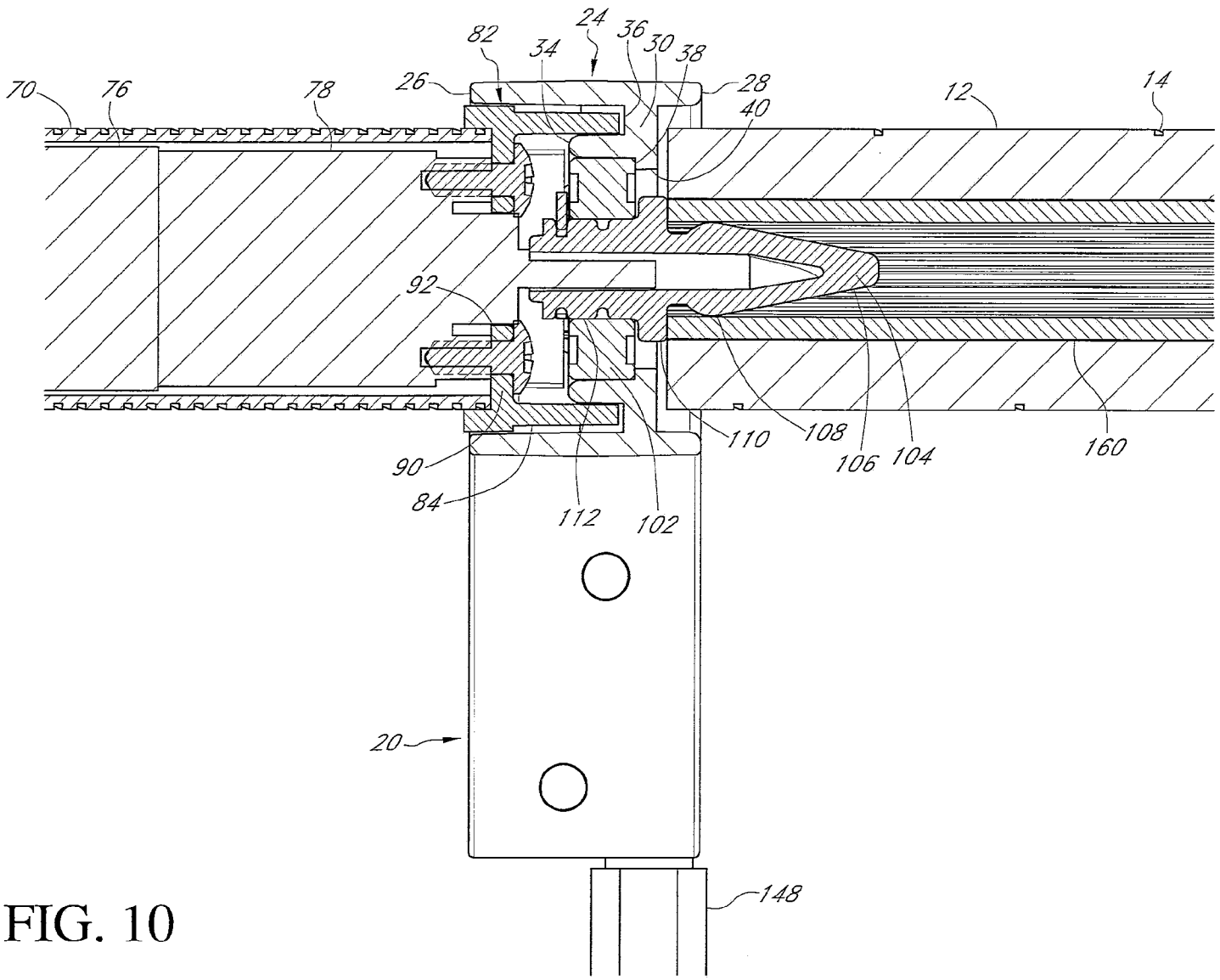
FIG. 10 is side elevation cut-away view of the motor housing shown in FIG. 7 connected to a rotatable drive element through a motor bracket, the view showing the motor coupler, bearing, planetary gear box, electrical motor, electrical plug and rotatable drive element.

In Operation—Single Motor Assembly:

In the arrangement wherein only a single motor housing 18 is connected to the combined rotatable drive element 12 (such as is shown in FIGS. 1 & 2) the single motor housing 18 rotates both rotatable drive elements 12. In this arrangement, the motor housing 18 is installed on the left bracket 16 and locked in place by the mating engagement of key-features 42, 94 as well as the engagement of locking-screw 184, which prevents rotation of motor housing 18 when motor 76 rotates. With motor coupler 104 inserted into the motor coupler sleeve 160, as motor 76 rotates, the components of transmission 78 rotate which rotates drive shaft 80 which rotates motor coupler 104 on bearing 102. This rotation is transferred through the motor coupler sleeve 160 and thereby rotates the first rotatable drive element 12. The rotation of the first rotatable drive element 12 is transferred through center coupler 172 to rotate the second rotatable drive element 12. The end opposite motor housing 18 of the second rotatable drive element 12 rotates freely upon bearing 102 and is supported by the right bracket 16. In this way, a single motor housing 18 rotates dual rotatable drive elements 12. In this arrangement, when the center coupler 172 is supported by a bracket 16, the bearings 178 allow free rotation of the rotatable drive elements 12 within the mounting member 24 of the bracket 16.

Actuation:

In this arrangement, motor 76 of architectural covering 10 can be actuated in any one of a plurality of methods and manners. Motorized control of architectural covering 10 can be implemented in several ways. As examples, the motor 76 can be actuated by tugging on the architectural covering 10, by using a remote control device using RF communication, by using a voice command and a voice command module, an internet enabled application, or any other method.

Tugging:

One method of actuating the motor 122 is through tugging the architectural covering 10. This method and system is more fully described in Applicant's related patent application entitled Low-Power Architectural Covering Ser. No. 61/811,650 filed on Apr. 12, 2013 which is fully incorporated by reference herein. A tug is defined a small manual movement of the architectural covering. This tug is sensed by a tug sensor such as an accelerometer, hall effect sensors, reed switch or the like as is more fully described in Applicant's related patent applications. When the tug sensor senses the tug, the system is woken up from a sleep state. In sleep state, power use is minimized to maximize battery life. When the system is woken up, the tug sensor senses the tug and the Microprocessor 118 deciphers the tug and determines how to actuate the motor 76.

In one arrangement, the microprocessor 118 is programmed to recognize, one, two, three, or more tugs separated by a predetermined amount of time, such as between a quarter second and one and a half seconds. However any other amount of time between tugs is here by contemplated such as ¼ second, ½ second, ¾ second, 1 second, 1&¼ seconds, 1&½ seconds, 1&¾ seconds, 2 seconds, and the like. When microprocessor 118 detects a single tug, pursuant to instructions stored in the memory 120 microprocessor 118 instructs motor 76 to go to a first corresponding position, such as open. When microprocessor 118 detects two tugs, pursuant to instructions stored in memory 120, the microprocessor 118 instructs motor 120 to go to a second corresponding position, such as closed. When microprocessor 118 detects three tugs, pursuant to instructions stored in memory 120 microprocessor 118 instructs motor 122 to go to a third corresponding position, such as half open. Any number of tugs and positions can be programmed.

Remote Control and Voice Control Operation:

One method of actuating the motor 76 is through using a wireless remote 196. This method and system is more fully described in Applicant's related patent application entitled System and Method for Wireless Voice Actuation of Motorized Window Coverings Ser. No. 61/807,846 filed on Apr. 3, 2013 which is fully incorporated by reference herein. In that application, as is contemplated herein, a wireless remote 196 is actuated by the user, by pressing a button. When actuated, the wireless remote 196 transmits an electromagnetic signal over-the-air, which is received by the antenna 124 of the motor controller assembly 68, Once antenna 124 receives the electromagnetic signal it is transmitted to receiver or transceiver 122 which converts the signal and transmits it to microprocessor 118. Microprocessor 118 interprets the signal based on instructions stored in memory 120 and actuates the architectural covering 10 to the predetermined position. As is also presented in that application, is a voice actuation module 198, which receives a user's voice command, converts it to an electromagnet signal which is received by architectural covering 10 in the manner described herein.

Internet Control and Operation:

One other method of actuating the motor 76 is through use of the internet and use of an electronic device. This method and system is more fully described in Applicant's related patent application entitled System and Method for Wireless Communication With and Control of Motorized Window Coverings Ser. No. 61/807,804 filed on Apr. 3, 2013 which is fully incorporated by reference herein. In that application, as is contemplated herein, motor 76 is actuated by a user having an internet enabled handheld device, such as a laptop, tablet or smartphone, which transmits a signal through the internet which is received at a gateway which then transmits an electromagnetic signal to the architectural coverings 10 as is described herein.

In Operation—Dual Motor Assembly:

In the arrangement wherein a motor housing 18 is connected to both ends of the combined rotatable drive element 12 there are two modes of operation. The first mode of operation includes where the center coupler 172 does not allow for independent rotation of rotatable drive elements 12. In this arrangement, the two motor housings 12 combine to contribute to the rotation of the combined rotatable drive elements 12. In this arrangement, a benefit is that the two motor housings 18 provide additional power and torque for the application. In this arrangement, a drawback is that the two motor housings 18 should be actuated simultaneously and be tuned to operate in cooperation with one another, otherwise one motor housing 18 will be working against the other.

In an alternative arrangement, center coupler 172 allows for independent rotation of rotatable drive elements 12 upon bearings 178. In this arrangement, a single motor housing 18 only rotates a single rotatable drive element 12. This eliminates coordinating opposing motor housings 18 as one will not affect the other. This also provides for independent actuation of one side of the architectural covering 10 while leaving the opposing side unaffected.

Coordination of Dual Motor Housings:

In the arrangement wherein two motor housings 18 are used, coordination of the two motor housings 18 may be desired. That is, in some applications it is desirable to turn on and turn off motors 76 at the same time. In other applications it is also important to rotate the motors 76 at the same speed. There are multiple ways to accomplish this coordination. In one arrangement, the two motor housings 18 are connected by an electrical conduit, such as a wire, which transmits control signals from one motor housing 18 to the other motor housing 18. More specifically, the two motor controller assemblies 68 are connected to one another and communicate with one another. This ensures that when one motor housing 18 receives a control signal, such as through a tug or through a wireless or electromagnetic signal, that the control signal is relayed to the other motor housing 18. This ensures when one motor housing 18 receives a control signal so does the other motor housing 18.

In another arrangement, the two motor housings 18 are wirelessly connected to one another. In this arrangement, the motor controller assemblies 68 of each motor housing 18 have a transceiver 122, instead of a receiver, which allows for sending as well as receiving control signals. In this arrangement, when a control signal is received by one motor controller assembly 68, the transceiver 122 re-broadcasts or relays the control signal which is received by the transceiver 122 of the other motor controller assembly 68. In this way, the two motor controller assemblies 68 communicate with one another to ensure the control signals have been received by both motor controller assemblies 68.

Additional information is also transmitted from motor housing 18 to motor housing 18 in the ways described herein, such as wirelessly or through wired communication. This information can include as speed, location, state (such as awake or asleep mode) and the like so as to coordinate operation and actuation of the two motors 76.

Conductive Brackets:

In one arrangement, the brackets 16 are formed of a conductive material such as steel, copper, aluminum, an alloy or the like. In this arrangement, the bracket 16 itself can be used as a pathway or conductor for carrying electricity from battery tube assembly 136. In this way, when plug 148 connects to socket assembly 64 a conduit 50 or wire can be eliminated because this conduit 50 has been replaced by the bracket itself. This reduces cost of the system and eases the assembly by eliminating a part.

Components Recess:

In one arrangement, the motor controller assembly 68 is positioned within the components recess 66 of bracket 16. In this arrangement, all the necessary components for controlling motor 76 are positioned within the bracket 16. As one example, antenna 124, receiver or transceiver 122, memory 120 and microprocessor 118 are positioned within components recess 66 of bracket 16. This arrangement allows for a smaller motor housing 18 which improves the aesthetic appearance of design.

Knurling:

In one arrangement, guide structure 14 can be formed into the exterior surface of the rotatable drive elements 12, motor housings 18 and rotatable drive element extensions 182. Knurling is a method used to cut or roll a pattern onto a material such as plastic or metal. This process is typically performed on a lathe, though in some cases a hand knurling tool will be used instead. A knurled object may have a threaded, diamond, crisscrossed, or straight line pattern imparted on it that adds both functionality and pleasing aesthetics. Knurling is often meant to provide a better gripping surface than offered by the bare material.

The primary method used to knurl objects is a lathe process that uses a very hard roller to press the desired shape into the work material. A roller with a reverse imprint of the desired knurl is held in a knuckle or jig and then pressed into the piece being worked on. The main configurations used for this type of knurling contain either one or two rollers. A straight knurl can be pressed by one roller, but any type of a diamond or crisscrossed design will require rollers with opposing patterns. The drawback of this process is that the rollers need to be matched to the unique outer diameter of each workpiece, so it is best for the mass production of many identical components.

Figure 11:
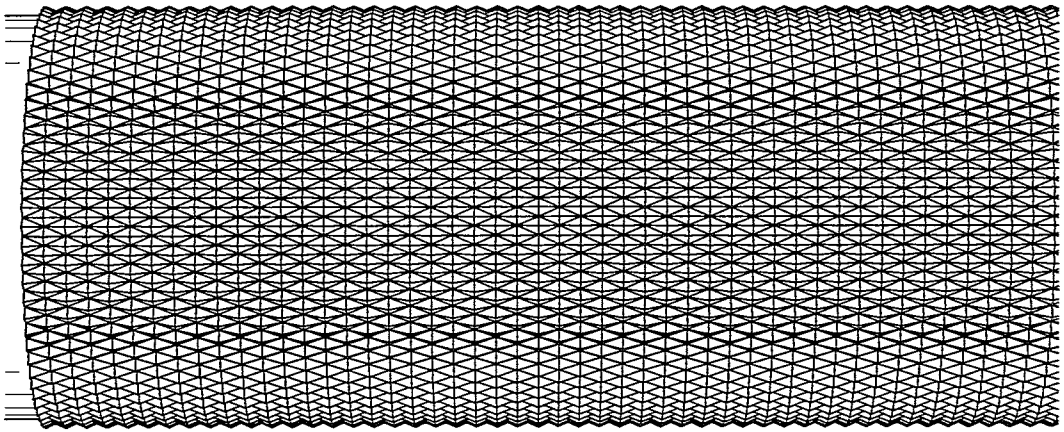
FIG. 11 is a side plan view of a diamond shaped, cross-threaded, or crisscrossed knurled pattern in the surface of a rotatable drive element.
Figure 12:
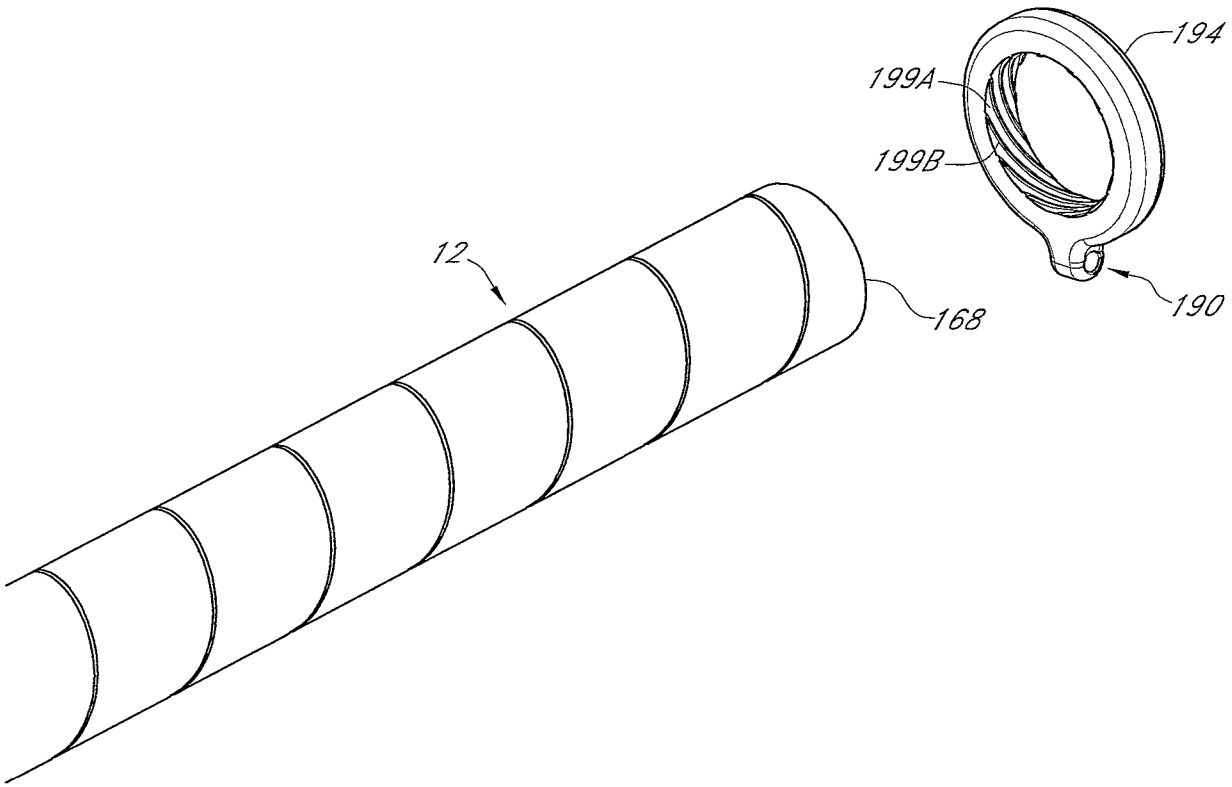
FIG. 12 is a perspective view of a rotatable drive element having a threaded surface and a driver attachment element showing a lower density of teeth on the interior surface of the driver element than the number of threads in the surface of the rotatable drive element.
Figure 13:
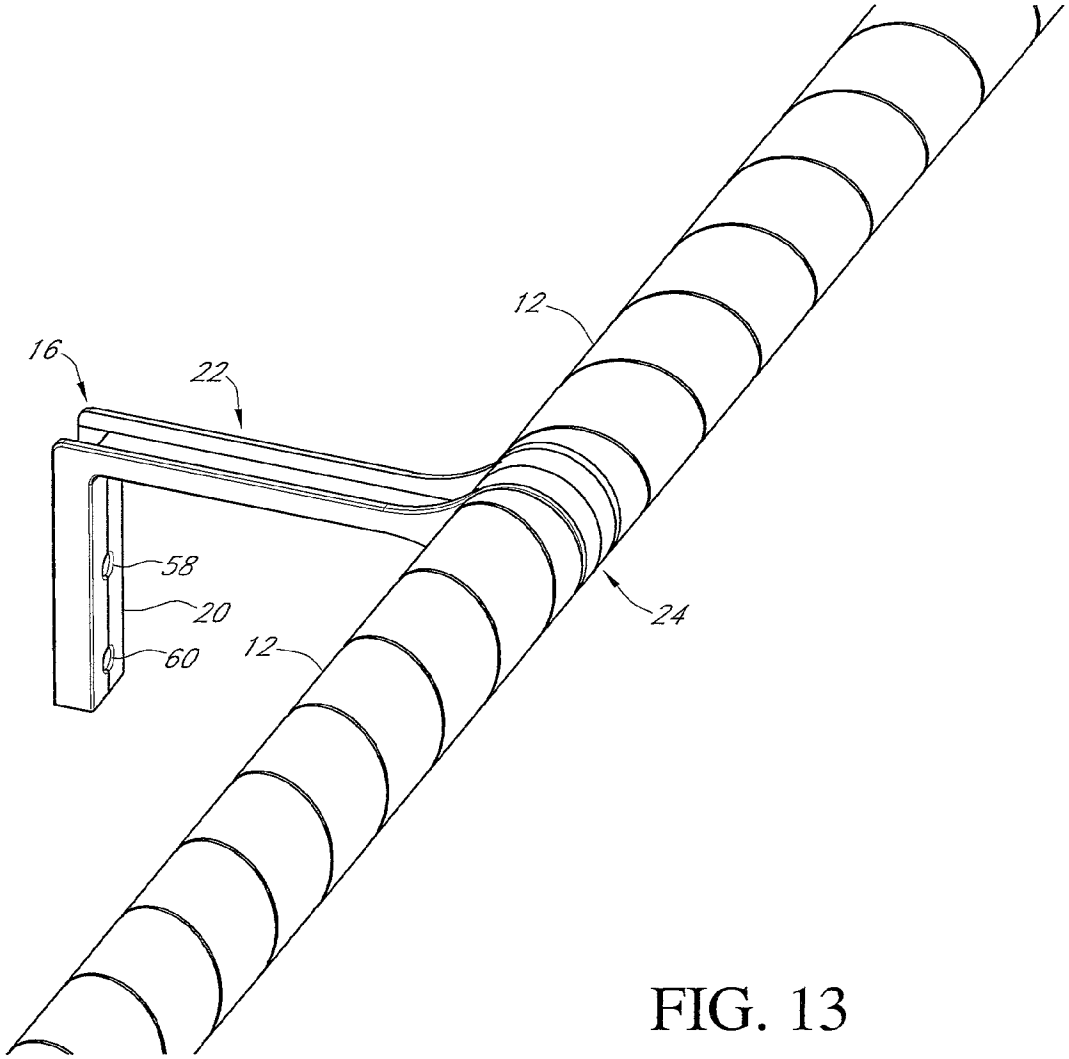
FIG. 13 is a perspective view of the rotatable drive elements connected together at a center bracket, the center coupler being positioned within the bracket and the open interior of the rotatable drive element.
Figure 14:
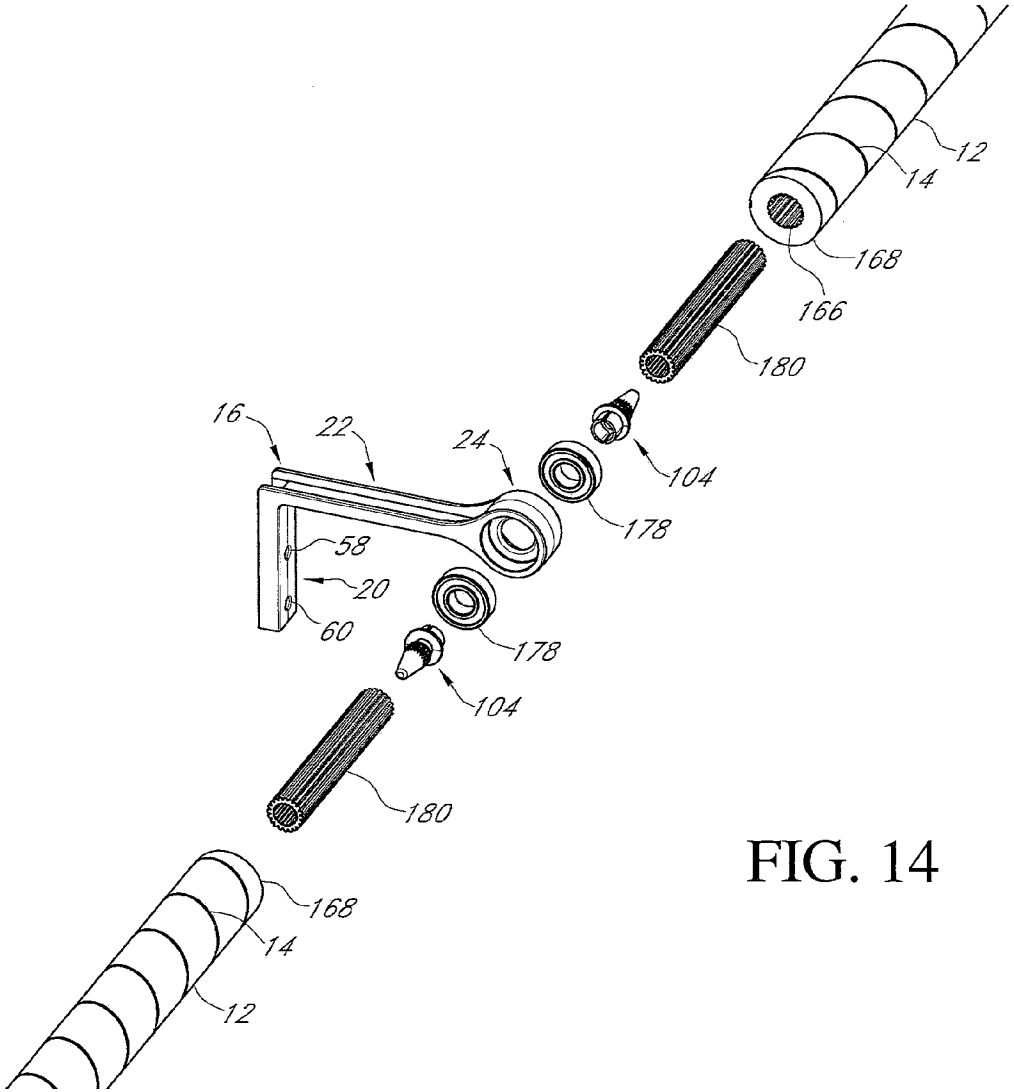
FIG. 14 is a perspective exploded view of FIG. 13.
Figure 15:
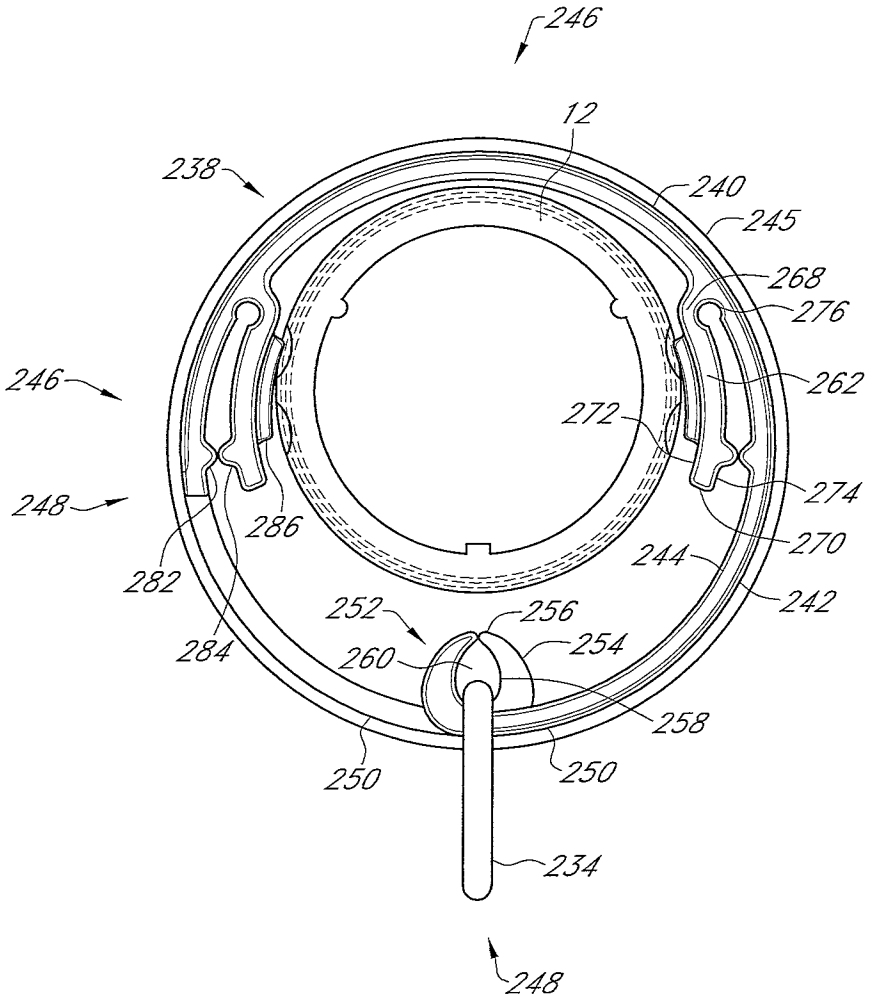
FIG. 15 is a side elevation view of a drive attachment element.
Figure 16:
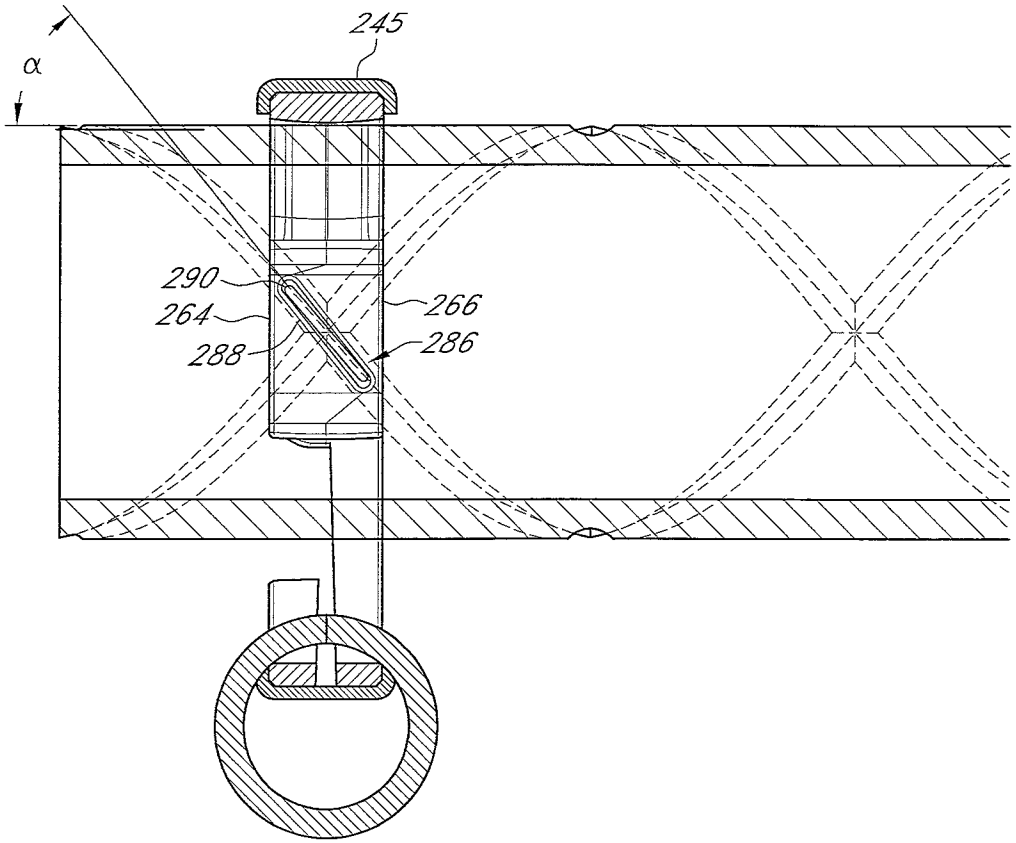
FIG. 16 is a front elevation cut-away view of the drive attachment element of FIG. 15 positioned over rotatable drive element.
Figure 17:
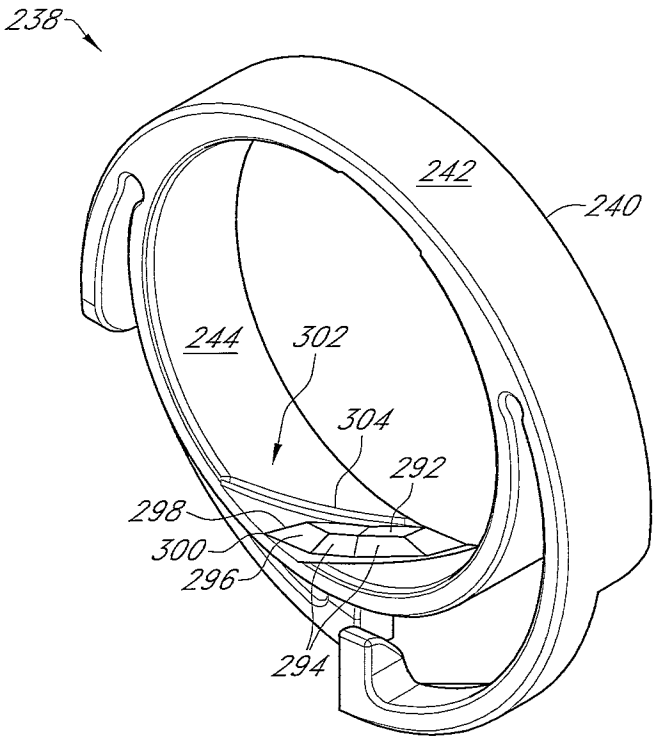
FIG. 17 is a perspective view of the drive attachment element of FIG. 15.
Figure 18:
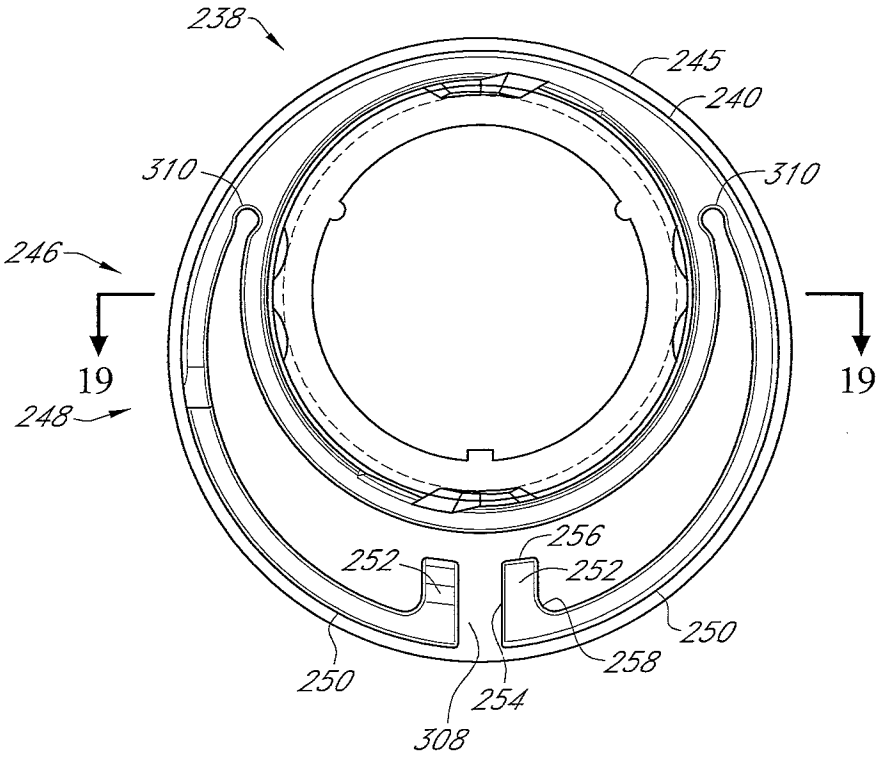
FIG. 18 is a front elevation view of another embodiment of a drive attachment element.
Figure 19:
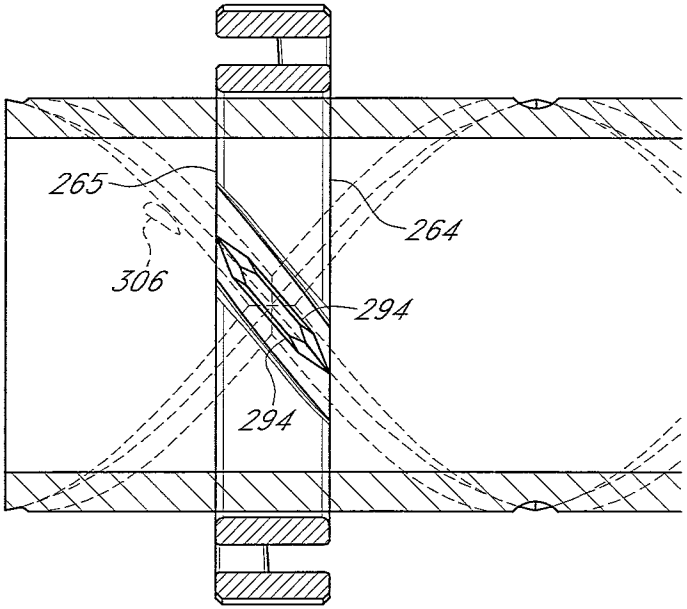
FIG. 19 is a front elevation cut-away view of the drive attachment element of FIG. 18 positioned over rotatable drive element.

In the arrangement shown, a crisscrossed or diamond pattern is knurled into the surface of rotatable drive elements 12. Knurling is a fast, inexpensive, durable, accurate and efficient method of imparting the guide structure 14 into the surface of the rotatable drive element 12. An example of the knurled surface imparted into the surface of rotatable drive element 12 is shown in FIG. 11 which is a diamond shaped pattern, a crisscrossed pattern or a cross-threaded pattern.

This pattern shows a high-density of threads which extend in a left-hand-rotation as well as a right-hand-rotation. This pattern also shows an extremely high-density of threads. Knurling is a desirable process because to impart this amount of threads in the surface of a rotatable drive element 12 by any other process would be extremely complicated and extremely time consuming.

Drive attachment element 194 engages the threaded and cross threaded pattern of the knurled surface. The interior surface 199A of drive attachment element has a tooth 199B that matingly engages the threads of the knurled pattern. As the rotatable drive element 12 is rotated, the tooth 199B of the drive element 12 rides along in the recesses or threads of the knurled surface which, depending on the direction of rotation, drives the drive attachment element 194 along the length of the rotatable drive element thereby opening and/or closing the architectural covering 10. A similar arrangement is more fully described in Applicant's related patent Application Ser. No. 61/702,093 filed on Sep. 17, 2012 entitled Rotatable Drive Element For Moving A Window Covering, which is fully incorporated by reference herein, including any related applications; and Applicant's related patent Application Ser. No. 61/810,949 filed on Apr. 11, 2013 entitled Rotatable Drive Element For Moving A Window Covering Including A Flexible Guide Arm And A Pointed Tooth Arrangement which is also fully incorporated by reference herein, including any related applications.

In one arrangement, an aluminum material is desirable for use as the rotatable drive element 12 for the ease of which a knurling process can be performed. To improve the sliding of the driver attachment element 194 there over, a composite material is used for the interior surface 199A of drive attachment element 194 and tooth 199B. To further improve the sliding of the driver attachment element 194 over the knurled surface of the rotatable drive element, a coating is imparted over the knurled surface of rotatable drive element 12 such as a Teflon material, anodizing or any other low friction coating.

Tooth Arrangement:

To also improve the sliding of the drive attachment element 194 over the knurled surface of the rotatable drive element 12 the interior surface 199A of rotatable drive element 12 has a lower density of teeth than the surface of rotatable drive element 12 has density of knurled threads. That is, as one example there is only one tooth 199B for every two knurled threads in the surface of the rotatable drive element 12. As another example, there is only one tooth 199B for every three knurled threads in the surface of the rotatable drive element 12. As another example, there is only one tooth 199B for every four knurled threads in the surface of the rotatable drive element 12. Other contemplated aspect ratios of teeth 199B to knurled threads include 1 for 5, 1 for 6, 1 for 7, 1 for 8, 1 for 9, 1 for 10, 1 for 11, 1 for 12, 1 for 15, 1 for 20, 1 for 25, 1 for 50, 1 for 75, 1 for 100 and the like. The reduction in the number of teeth 199B reduces the friction between the drive attachment element 194 and the rotatable drive element 12 which causes smoother operation and less consumption of energy.

Flexible Driver:

An improved drive attachment element 238 is presented. Drive attachment elements 238 are connected to and positioned around rotatable drive element 12. Drive attachment element 238 is formed of any suitable size, shape and design. In one arrangement, as is shown, drive attachment element 238 has a main body 240 that has a generally circular shape with an outside diameter surface 242 positioned in approximate parallel spaced relation to an inner diameter surface 244. The inner diameter 244 of drive attachment element 238 is larger than the outer diameter of rotatable drive element 12, such that drive attachment element 238 can fit over and receive rotatable drive element 12. Main body 240 of drive attachment elements 238 are positioned within a decorative ring 245, which, in one arrangement, has a similar outward appearance to the idler attachment elements 230. In one arrangement, the decorative ring 245 of drive attachment element 238 and idler attachment element 230 are practically identical, or identical with the only difference being the component(s) positioned within the decorative ring 245. In one arrangement, the interior components, such as drive attachment elements 238, rotate within a groove positioned within the inside diameter surface of decorative ring 245.

In one arrangement, decorative ring 245 is made of a metallic material, whereas the interior components are made of a plastic, composite or other non-metallic material. In one arrangement an acetal-type of plastic is used, especially over a Teflon-coated rotatable drive element as a low coefficient of friction occurs there between.

The main body 240 of drive attachment element 238 has a top region 246 which is generally unitary in nature, whereas the bottom region 248 terminates in separate opposing arms 250. Arms 250 are formed of any suitable size, shape and design. In the arrangement shown, arms 250 generally continue the arcuate curve of main body 240 of drive attachment element. Each arm 250 terminates in a hook portion 252. In one arrangement, opposing arms 250 are separated from one another and are flexible such that main body 240 can be placed over rotatable drive element 12 between arms 250. In one arrangement, a space is positioned between the ends of opposing arms 250; whereas in an alternative arrangement, no such space is positioned between opposing arms 250 and opposing arms 250 are in frictional engagement with one another. As can also be seen, each opposing arm 250 is aligned with one side of main body 240, that is, one arm 250 is aligned with the right side of main body 250, whereas the other arm 250 is aligned with the left side of main body 240. This staggering, or offset, allows the ends of hook portions 252 of opposing arms 250 to overlap, or extend past one another.

Hook portions 252 are formed of any suitable size, shape and design. In one arrangement, as is shown, hook portions 252 extend into the open interior of main body 240 with an arcuately curved exterior convex surface 254 connected at point or end 256 to an arcuately curved interior concave surface 258. Points 256 do not extend into the open interior of main body 240 to the point where they engage or interfere with rotatable drive element 12 when positioned therein. As opposing arms 250 overlap one another, opposing hook portions 252 also overlap one another. In the arrangement shown, opposing points 256 are in approximate horizontal alignment with one another, and the overlapped interior concave surfaces 258 form a space or opening 260 therebetween. Opening 260 is sized and shaped to receive a connection member 234, as is described herein, such as a ring, as is shown. The arcuately curved and concave surfaces 258 help to hold connection member 234 therein. In addition, when a connection member 234 is placed between the arcuately curved concave surfaces 258 of hook portions 252, connection members 234 prevent arms 250 from separating from one another, thereby providing rigidity to the bottom region 248 and main body 240 as a whole. As an example, when weight is applied to connection member 234 (such as the weight of a heavy curtain 236) arms 250 deflect or bend away from one another, thereby capturing connection member 234 between interior concave surfaces 258, which defines the maximum amount that arms 250 will bend away from one another.

Guide arms 262 are connected to drive attachment elements 238. Guide arms 262 are formed of any size, shape or design. In one arrangement, as is shown, guide arms 262 are connected to the interior surface of main body 240, or the inside diameter surface 244. In one arrangement, when viewed from the side, guide arms 262 extend the entire distance from a first lateral side 264 of drive attachment element 238 to a second lateral side 266 of drive attachment element 238. Guide arms 262 connect at their upper edge to the inside diameter surface 244 at pivot point 268 and extend downwardly and inwardly at an angle therefrom to where guide arm 262 terminates at end 270. Guide arms 262 have an interior surface 272 and an exterior surface 274. In one arrangement, as is shown, interior surface 272 and exterior surface 274 extend in generally parallel spaced relation to one another. Also, as is shown, guide arms 262 arcuately curve in the same general manner as main body 240 and rotatable drive element 12. That is the exterior surface 274 of guide arm 262 is generally convex in nature, and interior surface 272 of guide arm 262 is generally concave in nature. In one arrangement, this curvature is in the form of a partial portion of a circle. In one arrangement, the interior surface 272 of guide arm 262 arcuately curves in parallel spaced relation to the exterior surface of rotatable drive element 12, such that the interior surface 272 of guide arm 262 matchingly and matingly receives the exterior surface of rotatable drive element 12.

Guide arm 262 elastically pivots at pivot point 268. That is, opposing guide arms 262, with one guide arm 262 positioned opposite one another on the interior surface 244 of drive attachment elements 238, are initially biased to angle towards one another. Said another way, opposing guide arms 262 angle towards the open interior of drive attachment elements 238. To promote this pivoting, or bias pivot point 268 is intentionally weakened or designed to flex. In one arrangement, as is shown, when viewed from the side, a recess 276 is positioned at the intersection of guide arm 262 and main body 240, and/or adjacent pivot point 268. In one arrangement, as is shown, this recess 276 is, when viewed from the side, a semi-circular recess. This thinning of the material at pivot point 268 encourages bending, without breaking with the semi-circular recess 276 providing a rounded surface to ensure guide arm 262 resists cleaving or breaking at pivot point 262, thereby providing a longer useful life.

Guide arms 262 flex upon pivot point 268 between a maximum engagement position 278, and a maximum deflection position 280. A first bumper 282 is positioned in the inside diameter surface 244 of main body 240 and correspondingly positioned across from a second bumper 284 positioned in the exterior surface 274 of guide arm 262. Bumpers 282, 284 extend outwardly, or protrude, from their respective surfaces 244, 274. When bumpers 282, 284 engage one another, guide arm 262 is at its maximum deflection position 278.

At least one tooth 286, if not a plurality of teeth, extends outwardly from the interior surface of guide arms 262. Tooth 286, is formed of any suitable size and shape and design. In the arrangement shown, when viewed from the side, tooth 286 has a generally elongated shape with sidewalls 288 positioned in parallel spaced relationship with one another. Sidewalls 288 terminate at tooth ends 290. In this arrangement, tooth ends 290 are rounded or pointed so as to smoothly slide over any aberrations, burrs or abnormalities in rotatable drive element 12. In this arrangement, teeth 286 are sized and shaped to matingly receive the grooves or protrusions in rotatable drive element 12. That is, when helical guide structure 14 is a rounded groove, or semi-circular groove, teeth 286 are sized and shaped to be similarly rounded or semi-circular such that teeth 286 are received in the rounded groove of helical guide structure 14. Teeth 286 are positioned in angular alignment such that they extend across the side-to-side 264, 266 width of guide arms 262 at approximately the same angle $\alpha$ as the grooves in rotatable drive element 12. As can be seen in this arrangement, opposing teeth 286 on opposing guide arms 262 are essentially inverses of one another, or mirror images of one another.

In this arrangement, drive attachment element 238 is positioned over rotatable drive element 12 by sliding drive attachment element 230 over an end of rotatable drive element 12. Alternatively, drive attachment element 238 is positioned over rotatable drive element 12 by deflecting opposing arms 250, such that rotatable drive element 12 is received within the open interior within inside diameter surface 244. Once in this position, guide arms 262 engage the exterior surface of rotatable drive element 12 and opposing teeth 286 align with and fit within the helical guide structure 14 in the exterior surface of rotatable drive element 12. When teeth 286 are received within helical guide structure 14, the maximum engagement position 278 is achieved. In this position, due to gravitational forces in combination with the inward bias of guide arms 262, teeth 286 are forcibly held within the grooves of helical guide structure 14.

In this arrangement, as rotatable drive element 12 is rotated, drive attachment element 238 is driven along the lateral length of rotatable drive element 12 from end to end. Care is taken to ensure that drive attachment element 238 is oriented in the correct manner, such that when the rotatable drive element 12 is rotated, the drive attachment element 238 travels in the desired linear direction.

When drive attachment element 238 is positioned over rotatable drive element 12, arms 250 again overlap one another and connection member 234 is positioned in the space 260 between opposing hook portions 252. This connection member 234 prevents arms 250 from separating from one another, prevents drive attachment element 238 from coming off of rotatable drive element 12 and further adds structural rigidity to the lower end of drive attachment element 238. In addition, decorative ring 245 prevents arms 250 from separating from one another. That is, while arms 250 can be compressed to be inserted within the interior diameter of decorative ring 245, once positioned therein, when the outside surface of arms 250 engage the interior surface of decorative ring 245, the decorative ring 245 prevents any further extension of arms 250 away from one another.

As the rotatable drive element 12 rotates, teeth 286 ride within helical guide structure 14 thereby driving drive attachment elements 230 along the length of rotatable drive element 12. As the drive attachment element 230 encounters aberrations, burrs, size variations in the rotatable drive element 12 or any other abnormality in the surface of rotatable drive element 12, guide arms 262 deflect, bend or pivot at pivot point 268, inwardly or outwardly. In this way, the inward bias, as well as the outward flexibility of guide arms 262 compensates for variations, burrs, etc. in the rotatable drive element 12. This allows for more consistent operation of drive attachment elements 238 and prevents dislodgement of teeth 286 from helical guide structure 14; as well as preventing rotation of drive attachment elements 238 on rotatable drive element 12 when an aberration, burr or other abnormality is encountered.

Pointed Tooth Driver:

In an alternative arrangement, instead of teeth 286 being smooth and rounded, teeth 286 are sharp, flat, square and pointed. More specifically, in this arrangement, teeth 286 have a flat upper surface 292 that arcuately curves in parallel spaced relation to the inside diameter surface 244. When viewed from the side, opposing side panels 294 connect at their bottom edge to the inside diameter surface 244. Opposing side panels 294 angle inwardly towards one another from their bottom edge to their top edge where they connect to flat upper surface 292, at which point side panels 294 terminate. Like flat upper surface 292, opposing side panels 294 similarly arcuately curve in relation to inside diameter surface 244. Alternatively, side panels 294 are flat and square and do not arcuately curve in relation to inside diameter surface 244. In this arrangement the pair of opposing end panels 296 form the tooth end 290. As is shown, opposing end panels 296 connect at their rearward upper edge to the flat upper surface 292 and angle inwardly toward one another and downwardly toward inside diameter surface 244. In this arrangement, opposing end panels 296 connect at their lower edge to inside diameter surface 244, and connect at their inward edge to one another at seam line seam line 298 which terminates at point 300 which is the intersection of opposing side panels 294 and inside diameter surface 244. In this arrangement, opposing panels and seam line 298 form a pointed wedge.

In one arrangement, teeth 286 are positioned within recessed groove 302. Recessed groove 302 is recessed below the inner diameter surface 244 and is generally flat and positioned in parallel spaced relation to inside diameter surface 244 and outside diameter surface 242. The edges 304 of recessed groove 302 are extend in parallel spaced relation to one another and generally perpendicular to the inside diameter surface 244 and outside diameter surface 242. In one arrangement, recessed groove 302 and edges 304 thereof, extend in parallel spaced relation with the length of teeth 286. In one arrangement, teeth 286 are approximately positioned in the center of groove 302. In the arrangement shown, teeth 286 are positioned across main body 240 from one another, in one arrangement a tooth 286 is positioned approximately at the 12-o-clock position and a second tooth is positioned approximately at the 6-o-clock position, however any other position is hereby contemplated.

In this arrangement, teeth 286 protrude outwardly from recessed groove 302 such that the flat upper surface 292 of teeth 286 extend above the inside diameter surface 244 of recessed groove 302. This spacing around teeth 286 allows provides an area or space between teeth and inside diameter surface 244 which allows for the passage of burrs 306 that have a tendency to form adjacent the upper edge of helical guide structure 204. It is also hereby contemplated to use grooves 302 in association with the flexible guide arms 262 described above.

In the arrangement wherein one tooth 286 protrudes from the top center of main body 240, and a second tooth protrudes from the bottom center of main body 240, this arrangement prevents or resists vertical tilting of drive element 238. In the arrangement wherein one tooth 286 protrudes from the left side of main body 240, and a second tooth protrudes from the right side of main body 240, this arrangement prevents lateral tilting of drive element 238. As such, each arrangement is particularly well suited for specific applications.

Also, in the alternative arrangement, drive attachment element 238 includes has a main body 240 that has a generally circular shape with an outside diameter surface 242 positioned in approximate parallel spaced relation to an inside diameter surface 244. The inner diameter 244 of drive attachment element 238 is larger than the outer diameter of rotatable drive element 12, such that drive attachment element 238 can fit over and receive rotatable drive element 12. In this arrangement, main body 240 of drive attachment element 238 has a top region 246 which is generally unitary in nature, wherein the main body 240 forms a solid continuous circle.

In this arrangement, arms 250 are formed of any suitable size, shape and design. In the arrangement shown, arms 250 are connected to the outside diameter surface 242 of main body 240. In the arrangement shown, opposing arms 250 connect to main body 240 at approximately the 2-o-clock to 3-o-clock region and the 9-o-clock to 10-o-clock region as one example. Arms 250 arcuately curve around main body 240 of drive attachment element from top region 246 to bottom region 248. Each arm 250 terminates in a hook portion 252.

In one arrangement, in a static position the ends of opposing arms 250 are separated from one another by a space 308. As can also be seen, each opposing arm 250 is aligned with one side of main body 240, that is, one arm 250 is aligned with the right side of main body 250, whereas the other arm 250 is aligned with the left side of main body 240, however such staggering is not required.

Hook portions 252 are formed of any suitable size, shape and design. In one arrangement, as is shown, hook portions 252 extend upwardly towards main body 240. Hook portions 252 have a straight or arcuately curved convex exterior surface 254 connected at point or end 256, which is flat, to a straight or arcuately curved interior concave surface 258. Opposing arms 250 are flexible and pend at pivot point 310. In the arrangement shown, a connection member 234 is held between opposing flat exterior surfaces 254 of hook portions 252. When a connection member 234 is placed between the opposing exterior surfaces 254 of hook portions 252, connection members 234 prevent arms 250 from bending towards one another which prevents main body 240 from coming out of decorative ring 245.

In Operation:

A drive attachment element 238 is positioned over rotatable drive element 12 such that teeth 286 are received within the helical guide structure 14. Drive attachment element 238 is followed by a plurality of idler attachment elements which are also positioned over rotatable drive element 12.

In a two-way opening arrangement, a pair of opposing drive attachment elements 238 are positioned over rotatable drive element 12, one at each end of rotatable drive element 12, followed by a plurality of idler attachments 230.

A connection member 234 is positioned over arms 250 and between opposing hook portions 252 such that connection member 234 is held there between. Next shade material or a drapery is connected to connection members 234 by any means known in the art.

In this arrangement, as rotatable drive element 12 is rotated, teeth 286 ride within helical guide structure 14. As rotatable drive element 12 is rotated, drive attachment elements 238 are driven across the length of rotatable drive element 12. When burrs 306, or other manufacturing variances or deviations are encountered, the guide arms 262 flex and allow passage of the burrs 306 without interrupting operation.

When burrs 306, or other manufacturing variances or deviations are encountered the sharp teeth 286 tend to slide past the burr 306 without dislodging teeth 286 from guide structure 204. In addition, burrs 306 tend to pass within recessed groove 302, between the narrowed flat upper surface 292 of teeth 286 and the inside diameter surface 244 without engaging or interrupting operation.

From the above discussion it will be appreciated that the motorized drapery apparatus, system and method of use presented improves upon the state of the art.

Specifically, the motorized drapery apparatus, system and method of use shown and described herein is easy to use, efficient, simple, accurate, inexpensive, has a minimum number of parts, and has an intuitive design. Thus, one of ordinary skill in the art would easily recognize that all of the stated objectives have been accomplished.

It will be appreciated by those skilled in the art that other various modifications could be made to the device without parting from the spirit and scope of this invention. All such modifications and changes fall within the scope of the claims and are intended to be covered thereby.

What is claimed:

1. A motorized drapery system, comprising:

a drive element;

the drive element extending a length between a first end and a second end;

the drive element having a cylindrical shape and a helical guide structure;

the drive element connected to a structure by a first bracket positioned adjacent the first end of the drive element and a second bracket positioned adjacent the second end of the drive element;

a plurality of attachment elements connected to the drive element;

shade material connected to the plurality of attachment elements;

a motor housing;

the motor housing having a motor;

the motor housing operatively connected to the first end of the drive element;

a battery assembly, which holds a plurality of batteries, electrically connected to the motor housing to supply power to the motor housing;

wherein the battery assembly is external to the drive element and the motor housing;

wherein the battery assembly is positioned adjacent the first end of the drive element;

wherein the battery assembly is electrically connected to the motor by a transmission wire;

wherein the shade material forms a stack of shade material that hangs down from the drive element;

wherein when the motor rotates the drive element the plurality of attachment elements are moved laterally along the drive element;

wherein the battery assembly is positioned vertically behind the stack of shade material positioned adjacent the first end of the drive element such that the battery assembly is hidden behind the stack of shade material when the shade material is in an open position as well as in a closed position.

2. The motorized drapery system of claim 1 wherein when the motor rotates the drive element in a first direction the shade material is driven in the first direction and wherein when the motor rotates the drive element in a second direction the shade material is driven in the second direction.

3. A motorized drapery system, comprising:

a drive element;

the drive element extending a length between a first end and a second end;

the drive element having a cylindrical shape and a helical guide structure;

the drive element connected to a structure by a first bracket positioned adjacent the first end of the drive element and a second bracket positioned adjacent the second end of the drive element;

a plurality of attachment elements connected to the drive element;

shade material connected to the plurality of attachment elements;

a motor housing connected to the drive element;

the motor housing having a motor;

a battery assembly, which holds a plurality of batteries, electrically connected to the motor housing to supply power to the motor housing;

wherein the battery assembly is external to the drive element and the motor housing;

wherein the battery assembly is positioned adjacent the first end of the drive element;

wherein the battery assembly is electrically connected to the motor by a transmission wire;

wherein the shade material forms a stack of shade material that hangs down from the drive element;

wherein when the motor rotates the drive element the plurality of attachment elements are moved laterally along the drive element;

wherein the battery assembly is positioned vertically behind the stack of shade material positioned adjacent the first end of the drive element such that the battery assembly is hidden behind the stack of shade material;

wherein the stack of shade material is present when the shade material is in an open position as well as in a closed position; and wherein the battery assembly plugs into the first bracket.

4. A motorized drapery system, comprising:

a drive element;

the drive element extending a length between a first end and a second end;

the drive element having a cylindrical shape and a helical guide structure;

the drive element connected to a structure by a first bracket positioned adjacent the first end of the drive element and a second bracket positioned adjacent the second end of the drive element;

a plurality of attachment elements connected to the drive element;

shade material connected to the plurality of attachment elements;

a motor housing connected to the drive element;

the motor housing having a motor;

a battery assembly, which holds a plurality of batteries, electrically connected to the motor housing to supply power to the motor housing;

wherein the battery assembly is external to the drive element and the motor housing;

wherein the battery assembly is positioned adjacent the first end of the drive element;

wherein the battery assembly is electrically connected to the motor by a transmission wire;

wherein the shade material forms a stack of shade material that hangs down from the drive element;

wherein when the motor rotates the drive element the plurality of attachment elements are moved laterally along the drive element;

wherein the battery assembly is positioned vertically behind the stack of shade material positioned adjacent the first end of the drive element such that the battery assembly is hidden behind the stack of shade material;

wherein the stack of shade material is present when the shade material is in an open position as well as in a closed position; and wherein the first bracket having a key-feature, wherein the motor housing connects to the first bracket such that the motor housing engages the key-feature of the first bracket thereby locking the motor housing in place.

5. A motorized drapery system, comprising:

a drive element;

the drive element extending a length between a first end and a second end;

the drive element having a cylindrical shape and a helical guide structure;

the drive element connected to a structure by a first bracket positioned adjacent the first end of the drive element and a second bracket positioned adjacent the second end of the drive element;

a plurality of attachment elements connected to the drive element;

shade material connected to the plurality of attachment elements;

a motor housing connected to the drive element;

the motor housing having a motor;

a battery assembly, which holds a plurality of batteries, electrically connected to the motor housing to supply power to the motor housing;

wherein the battery assembly is external to the drive element and the motor housing;

wherein the battery assembly is positioned adjacent the first end of the drive element;

wherein the battery assembly is electrically connected to the motor by a transmission wire;

wherein the shade material forms a stack of shade material that hangs down from the drive element;

wherein when the motor rotates the drive element the plurality of attachment elements are moved laterally along the drive element;

wherein the battery assembly is positioned vertically behind the stack of shade material positioned adjacent the first end of the drive element such that the battery assembly is hidden behind the stack of shade material;

wherein the stack of shade material is present when the shade material is in an open position as well as in a closed position; and wherein electronic components that control the motor are positioned in the first bracket.

6. A motorized drapery system, comprising:

a first drive element;

the first drive element having a first end and a second end;

a first bracket connected to the first end of the first drive element;

a plurality of attachment elements connected to the first drive element;

shade material connected to the plurality of attachment elements;

a first motor housing having a first end and a second end, the second end of the first motor housing connected to the first bracket;

the first motor housing having a first motor;

a battery assembly, which holds a plurality of batteries, electrically connected to the first motor housing to supply power to the first motor housing;

wherein the battery assembly is electrically connected to the motor by a transmission wire;

wherein the shade material forms a stack of shade material that hangs down from the first drive element;

wherein the battery assembly is positioned behind the stack of shade material positioned adjacent the first end of the first drive element such that the battery assembly is hidden behind the stack of shade material;

wherein the first motor of the first motor housing rotates the first drive element while the first motor housing remains stationary;

wherein the first motor and a first motor sensor assembly are positioned within the first motor housing connected to the first bracket;

wherein a decorative finial is connected to the first motor housing such that the first motor is housed within the decorative finial on one side of the first bracket and connects to the first drive element on the opposite side of the first bracket such that the motor causes rotation of the first drive element.

7. The motorized drapery system of claim 6 further comprising a second drive element having a first end and a second end, the first end of the second drive element is connected to the second end of the first drive element to form an elongated drive element.

8. The motorized drapery system of claim 6 wherein a second motor housing having a first end and a second end is connected to a second end of a second drive element.

9. The motorized drapery system of claim 6 further comprising a second drive element having a first end and a second end, the first end of the second drive element is connected to the second end of the first drive element to form an elongated drive element wherein the first drive element rotates independently of rotation of the second drive element.

10. The motorized drapery system of claim 6 wherein the first motor sensor assembly is configured to sense the position or rotation of the first drive element.

11. The motorized drapery system of claim 6 wherein the first motor sensor assembly includes a magnet wheel operatively connected to a motor shaft of the first motor.

12. A motorized drapery system, comprising:

a first drive element;

the first drive element having a first end and a second end;

a first bracket connected to the first end of the first drive element;

a plurality of attachment elements connected to the first drive element;

shade material connected to the plurality of attachment elements;

a first motor housing having a first end and a second end, the second end of the first motor housing connected to the first bracket;

the first motor housing having a first motor;

a battery assembly, which holds a plurality of batteries, electrically connected to the first motor housing to supply power to the first motor housing;

wherein the battery assembly is electrically connected to the motor by a transmission wire;

wherein the shade material forms a stack of shade material that hangs down from the first drive element;

wherein the battery assembly is positioned behind the stack of shade material positioned adjacent the first end of the first drive element such that the battery assembly is hidden behind the stack of shade material;

wherein the first motor of the first motor housing rotates the first drive element while the first motor housing remains stationary;

wherein the first motor and a first motor sensor assembly are positioned within the first motor housing connected to the first bracket;

wherein a decorative finial is connected to the first motor housing such that the motor is housed within the decorative finial on one side of the first bracket and connects to the rotatable drive element on the opposite side of the first bracket such that the motor causes rotation of the drive element; and wherein electronic components that control the first motor are positioned in the first bracket.

13. A motorized drapery system, comprising:

a first drive element, the first drive element extending a length between a first end and a second end;

a second drive element, the second drive element extending a length between a first end and a second end;

a first bracket connected to the first end of the first drive element;

a second bracket connected to the second end of the second drive element;

a first motor housing having a first motor;

a battery assembly, which holds a plurality of batteries, electrically connected to the first motor housing to supply power to the first motor housing;

wherein the battery assembly is electrically connected to the first motor by a transmission wire;

wherein the first drive element is connected to the second drive element by a center coupler;

a plurality of attachment elements connected to the first drive element and the second drive element;

a first shade material connected to the plurality of attachment elements that forms a first stack of shade material;

wherein the battery assembly is positioned behind the first stack of shade material positioned adjacent the first end of the first drive element such that the battery assembly is hidden behind the first stack of shade material;

wherein the first stack of shade material is present when the first shade material is opened or closed by rotating the first drive element or the second drive element;

wherein the first motor and a first motor sensor assembly are positioned within the first motor housing connected to the first bracket;

wherein a decorative finial is connected to the first motor housing such that the first motor is housed within the decorative finial on one side of the first bracket and connects to the first drive element on the opposite side of the first bracket such that the first motor causes rotation of the first drive element.

14. The motorized drapery system of claim 13 wherein the first drive element rotates independently of rotation of the second drive element.

15. The motorized drapery system of claim 13 wherein the center coupler binds the first drive element and the second drive element together causing simultaneous rotation of the first drive element and the second drive element.

16. The motorized drapery system of claim 13 further comprising the first motor housing connected to the first end of the first drive element and a second motor housing connected to the second end of the second drive element, wherein the first motor housing rotates the first drive element and the second motor housing rotates the second drive element.

17. The motorized drapery system of claim 13 further comprising the first motor housing connected to the first end of the first drive element and a second motor housing connected to the second end of the second drive element, wherein the first motor housing and the second motor housing are electronically controlled together or communicate with one another so as to cooperate with one another or operate in unison.

18. The motorized drapery system of claim 13 wherein the first motor sensor assembly is configured to sense the position or rotation of the first drive element.

19. The motorized drapery system of claim 13 wherein the first motor sensor assembly includes a magnet wheel operatively connected to a motor shaft of the first motor.

* * * * *